US005235384A

United States Patent [19]

Oka et al.

[11] Patent Number: 5,235,384

[45] Date of Patent: Aug. 10, 1993

[54] IMAGE FORMING APPARATUS WITH REPLACEABLE PROCESS UNITS

[75] Inventors: Seiji Oka; Tomoji Ishikawa, both of Yokohama; Tsukuru Kai, Fujisawa; Hisashi Ishijima, Yokohama; Makoto Obu, Yokohama; Hidetoshi Yano, Yokohama, all of Japan

[73] Assignee: Ricoh Company, Ltd., Tokyo, Japan

[21] Appl. No.: 551,948

[22] Filed: Jul. 6, 1990

[30] Foreign Application Priority Data

| | | | |
|---|---|---|---|
| Jul. 4, 1989 | [JP] | Japan | 1-171200 |
| Aug. 3, 1989 | [JP] | Japan | 1-91791 |
| Sep. 11, 1989 | [JP] | Japan | 1-232842 |
| Sep. 11, 1989 | [JP] | Japan | 1-232843 |
| Sep. 11, 1989 | [JP] | Japan | 1-232844 |
| Oct. 16, 1989 | [JP] | Japan | 1-266279 |
| Oct. 16, 1989 | [JP] | Japan | 1-266280 |
| Mar. 16, 1990 | [JP] | Japan | 2-643363 |
| May 9, 1990 | [JP] | Japan | 2-117772 |

[51] Int. Cl.[5] ..... G03G 21/00

[52] U.S. Cl. ..... 355/208; 355/246; 355/313; 346/153.1

[58] Field of Search ..... 346/153.1; 355/204, 355/208, 246, 260, 313, 265

[56] References Cited

U.S. PATENT DOCUMENTS

| | | | |
|---|---|---|---|
| 3,700,323 | 10/1972 | Guyette et al. | 355/211 |
| 4,275,958 | 6/1981 | Tachika et al. | 355/313 |
| 4,666,290 | 5/1987 | Yoshiura | 355/209 |
| 4,739,367 | 4/1988 | Watanabe et al. | 355/204 X |
| 4,774,544 | 9/1988 | Tsuchiya et al. | 355/311 |
| 4,851,875 | 7/1989 | Tanimoto | 355/245 |
| 4,873,549 | 10/1989 | Tada et al. | 355/246 X |
| 4,974,020 | 11/1990 | Takamatsu et al. | 355/208 |
| 4,994,853 | 2/1991 | Fukuchi et al. | 355/208 |

FOREIGN PATENT DOCUMENTS

| | | |
|---|---|---|
| 512060 | 10/1985 | Fed. Rep. of Germany . |
| 3531775 | 3/1986 | Fed. Rep. of Germany . |
| 62-75667 | 4/1987 | Japan . |
| 62-231269 | 10/1987 | Japan . |
| 1145670 | 6/1989 | Japan . |
| 2091640 | 8/1982 | United Kingdom . |
| 2097332 | 11/1982 | United Kingdom . |

*Primary Examiner*—Michael L. Gellner
*Assistant Examiner*—P. Stanzione
*Attorney, Agent, or Firm*—Oblon, Spivak, McClelland, Maier & Neustadt

[57] ABSTRACT

An image forming apparatus having various process units at least one of which is removable for replacement. The apparatus has a mode selecting a device accessible for selecting desired one of a plurality of image modes. A photoconductive element, developing unit, image transferring unit and other replaceable process units each is provided with a storage for storing image forming conditions which match an image mode selected on the mode selecting device. A copy process and other conditions are set up on the basis of the conditions stored in the storage. Another storage is loaded with data associated with the service life of a replaceable process unit.

11 Claims, 24 Drawing Sheets

IMAGE FORMING APPARATUS WITH REPLACEABLE PROCESS UNITS

BACKGROUND OF THE INVENTION

The present invention relates to an electrophotographic copier, facsimile machine, printer or similar image forming apparatus and, more particularly, to an image forming apparatus having various process units at least one of which is removable for replacement.

PRIOR ART 1

An electrophotographic copier or similar image forming apparatus has various image forming process units such as a photoconductive element, optics for exposure, charging unit, and a developing unit. It has been customary with this kind of apparatus to adjust, every time any one of the process units is replaced, the exposing amount, charging amount and developing bias and other image forming conditions either singly or in combination. Such adjustment is not only time- and labor-consuming but also not always accurate, often resulting in poor image quality.

In light of this, there has been proposed an image forming apparatus which uses a replaceable process kit removable from the body of the apparatus for replacement and provided with a ROM or similar storage, as disclosed in, for example, Japanese Patent Laid-Open Publication No. 132758/1983 (hereinafter referred to as reference 1). Specifically, the process kit is an integral assembly of at least one or a part of a charging unit, developing unit, image transferring unit and a cleaning unit and a photoconductive drum. The ROM or similar storage provided on the process kit for allowing the apparatus body to select optimal image forming conditions matching the characteristics of the associated process units. In this configuration, when the process kit is replaced with another, adequate image forming conditions of the individual process units associated with the kit are automatically adjusted, whereby the previously stated problem is eliminated. Another scheme is the combination of bar codes and a bar code reader, as proposed in Japanese Patent Laid-Open Publication No. 16578/1990 (hereinafter referred to as reference 2). Specifically, this scheme is such that each replaceable part is provided with a bar code representative of various data necessary for control and, when it is newly inserted in the apparatus, a bar code reader reads the bar code. Then, the control values or initially set values of the apparatus are adjusted on the basis of the data read out of the bar code.

In both of the references 1 and 2 described above, a command for setting up adequate image forming conditions is transmitted only from the process kit or the replaceable part to the apparatus body, i.e., almost no signals are interchanged between the process kit or the individual parts and the apparatus body. The user, therefore, cannot freely select a desired image mode to the user's taste such as a solid image priority mode, photograph priority mode, line image priority mode, or color image priority mode. Specifically, to implement the selection of an image mode, the reference 1 needs a plurality of process units belonging to the same type but each being loaded with different data for executing a particular mode. For example, for a type A, there has to be prepared a type A process kit for a solid image priority mode, a type A process kit for a photograph priority mode, a type A process kit for a line image priority mode, and a type A process kit for a color image priority mode. Such a great number of process units directly translates into extremely troublesome management at the time of replacement and an increase in cost. When a process kit other than adequate one is mounted on the apparatus, e.g., when a type B process kit for a line image priority mode is inadvertently mounted in place of type A process kit for a solid image priority mode, the apparatus fails to produce a desired kind of image or practically fails to form an image. In the reference 2, each replaceable part is simply provided with a bar code, and data matching the individual parts are stored in a control section built in the apparatus body. However, storing all the data matching the individual parts whose characteristics are only slightly different in a single apparatus is not practical from the capacity standpoint and increases the cost.

None of the references 1 and 2 allows each replaceable unit or part of the process kit to see its own service life. Specifically, the references 1 and 2 both would need a special implementation for the detection of the life.

PRIOR ART 2

An image forming apparatus of the type using a replaceable cartridge filled with a toner or similar developer is extensively used. Such a cartridge has a life predetermined in terms of the amount of toner filled therein, and it is replaced periodically as the life expires. Specifically, the cartridge is replaced when the apparatus has performed its image forming operation over a predetermined period of time. Usually, some different cartridges (hereinafter referred to as developer toner magazines or DTM) are available such as for solid images, photographs, and color images, as desired. Although this allows the user to select a particular cartridge to the user's own taste, using a plurality of DTMs while replacing them makes it impossible to see the lives of the individual DTMs.

PRIOR ART 3

Another problem heretofore pointed out is that toner particles and impurities such as paper dust deposit on the surface of a photoconductive element and the charge wire of a charging unit, resulting in defective images such as an image with white stripes. When a defective image is produced, the user or a serviceman may clean the photoconductive element or the charge wire by hand. Alternatively, use may be made of an automatic cleaning unit for cleaning the photoconductive element, as proposed in the past. The cleaning unit has a cleaning blade for removing paper dust and similar impurities which are relatively easy to remove, and a sweeper roller which slightly shaves off the surface of a photoconductive element to remove toner filming and paper talc that are not easy to remove with the cleaning blade. The sweeper roller is rotated every time the photoconductive element is rotated so as to clean the latter. Concerning the charge wire, it may be automatically cleaned every time the image forming operation is repeated a predetermined number of times, as also proposed in the art.

Cleaning the surface of a photoconductive element and the charge wire by hand as stated above is apt to damage the surface of the photoconductive element and the charge wire when they are moved out of and then into the apparatus body. The sweeper roller scheme is undesirable because the sweeper roller is rotated every time the photoconductive element is rotated, thinning the photoconductive layer of the element little by little and thereby reducing the life of the element. Even when the charge wire is automatically cleaned every time the image forming operation is repeated a predetermined number of times, an adequate uniform charge cannot be deposited on the photoconductive element when the developing unit is replaced with another which uses a different kind of developer, e.g., when a developing unit using a black developer is replaced with another which uses a red developer. Specifically, although a black and a red toner substantially share the same upper limit of adequate charge potential, the red toner is higher than the black toner when it comes to the lower limit. As a result, even when the number of times of image forming operation is short of the predetermined one and the charge potential is adequate for the black toner, the charge potential would be lower than the adequate charge potential for the red toner.

PRIOR ART 4

There is also available an image forming apparatus of the type selectively operable with a black developing unit using a black developer and color developing units each using a developer of different color. Since various image forming conditions including the optimal developing bias differ from one developer to another, image forming conditions particular to the individual developing units are stored in the body of the apparatus and switched over depending on the desired developing unit.

However, loading a storage built in the apparatus with even the image forming conditions associated with the developing units which are not mounted is not practicable without resorting to a storage having a substantial capacity which would increase the cost. This problem is serious considering the increasing trend toward a multi-function image forming apparatus which involves a great amount of data to be stored. Typical of functions available with such an apparatus are an automatic paper selecting function, continuous page copying function, and image combining function.

SUMMARY OF THE INVENTION

It is therefore an object of the present invention to provide an image forming apparatus which is free from the various problems particular to the prior art as discussed above.

It is another object of the present invention to provide an image forming apparatus which is desirable from the function and reliability standpoint.

It is another object of the present invention to provide a generally improved image forming apparatus having replaceable process units.

In accordance with the present invention, an image forming apparatus comprises a body, an image carrier mounted on the body, an image forming device arranged around the image carrier for forming a desired visible image on the image carrier, an image transferring device for transferring the visible image to a paper sheet, a controller incorporated in the body for controlling operations of at least one of the image forming device and image transferring device, a storage provided on at least one of the image carrier, image forming device and image transferring device which is removable from the body for replacement, and a mode selecting device for generating a mode selection signal representative of, among a plurality of imge modes, a desired image mode selected thereon. Image forming conditions matching the desired image mode are written to the storage in response to the mode selection signal, while control conditions of the controller are set up on the basis of the image forming conditions.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention will be described in detail with reference to the accompanying drawings.

FIRST EMBODIMENT

Figure 1:
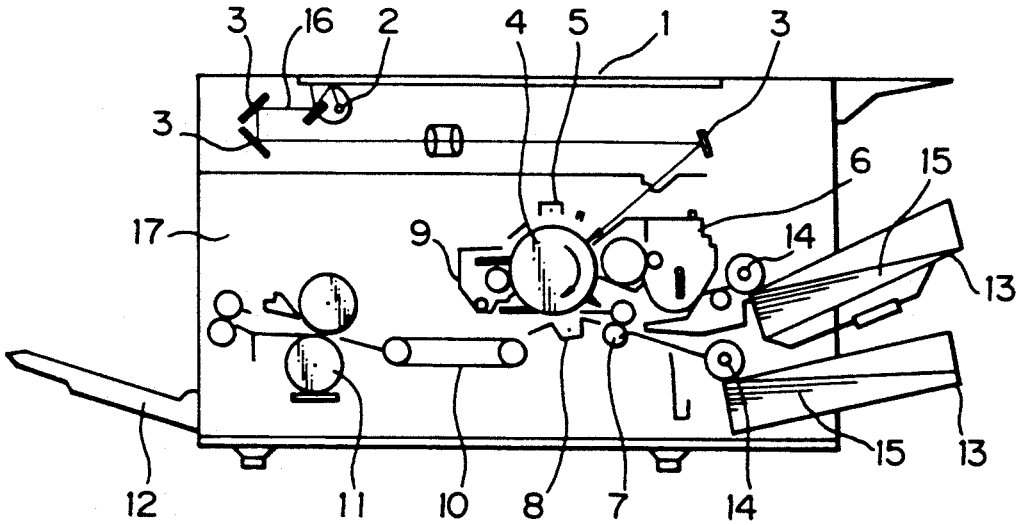
FIG. 1 is a view showing the general construction of an image forming apparatus with which a first embodiment of the present invention is practicable.

Referring to FIG. 1, an image forming apparatus embodying the present invention is shown. As shown, the apparatus has a glass platen 1, a light source 2, mirrors 3, a photoconductive drum 4, a charging unit 5, a developing unit 6, a register roller pair 7, a separating unit 8, a cleaning unit 9, a transport belt 10, a fixing unit 11, a copy tray 12, paper cassettes 13, feed rollers 14 each being associated with respective one of the paper cassettes 13, and paper sheets 15 loaded in the individual paper cassettes 13. While the drum 4 is rotated as indicated by an arrow in the figure, the charger 5 charges the surface of the drum 4. The charged surface of the drum 4 is exposed to image light by optics 16 which include the light source 2 and mirrors 3. The resulting latent image on the drum 4 is developed by the developing unit 6, whereby a toner image is formed on the drum 4. In synchronism with such a copying process, a paper sheet 15 is fed out from either one of the paper cassettes 13 so that the toner image is transferred to the paper sheet 15. The toner image is fixed on the paper sheet 15 by the fixing unit 11. After the image transfer, the cleaning unit 9 removes toner particles remaining on the drum 4.

The drum 4, optics 16, developing unit 6, cleaning unit 9 and fixing unit 11 are individually removable from the body 17 of the apparatus for replacement. While the following description will concentrate on the replacement of the developing unit 6 for the simplicity of description, it should be noted that the control over the conditions of an image matching any desired image modes which will be described are similarly practicable with the other replceable units also.

Figure 2:
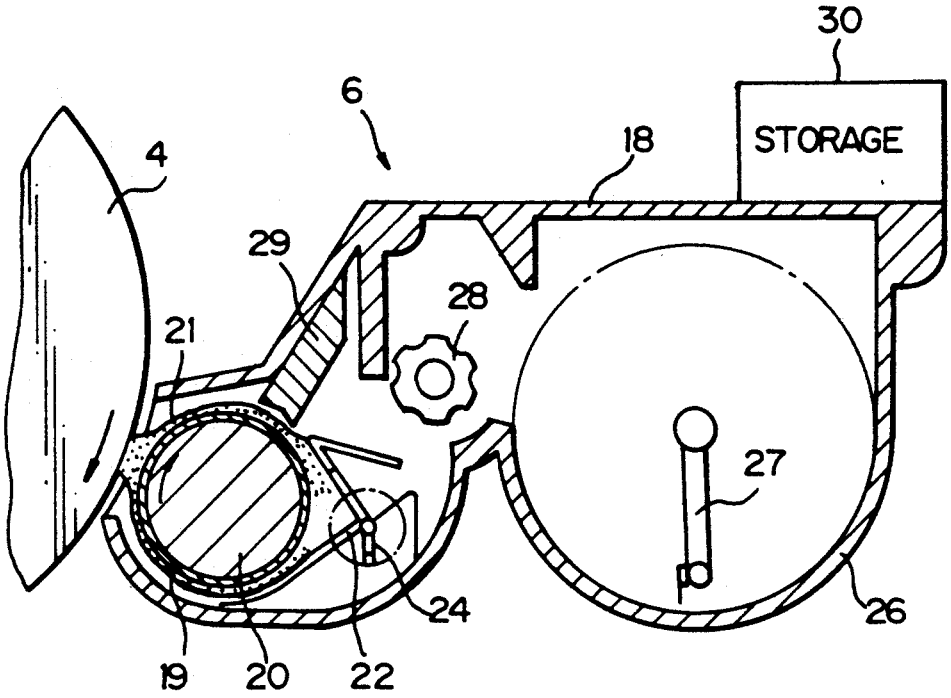
FIG. 2 is a section of a developing unit usable with the apparatus of FIG. 1.
Figure 3:
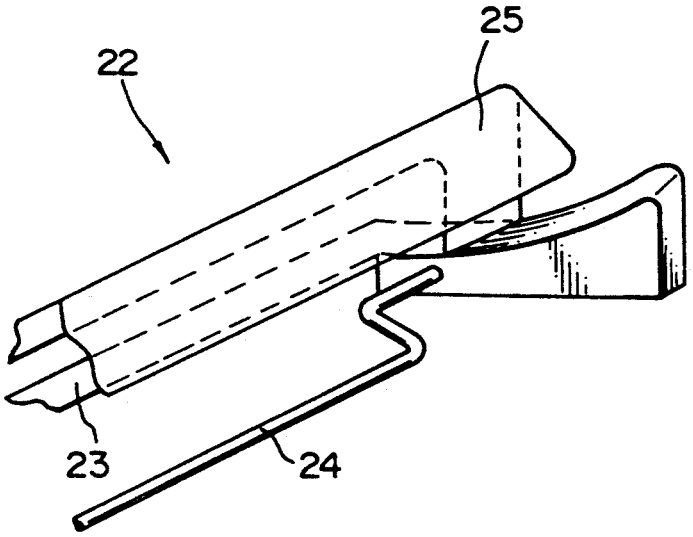
FIG. 3 is a fragmentary perspective view of a developer scraping body forming a part of the developing unit shown in FIG. 2.

As shown in FIGS. 2 and 3, the developing unit 6 has a casing 18 which accommodates therein a developer carrier in the form of a developing sleeve 19. The developing sleeve 19 partly faces the photoconductive drum 4 through an opening which is formed through the casing 18. The sleeve 19 is rotated counterclockwise as indicated by an arrow in FIG. 2. A developing region is defined between the facing portions of the drum 4 and sleeve 19. A magnet roller 20 is disposed in the sleeve 19 and has different polarities alternating with each other. A brush 21 consisting of magnetic carrier and toner is magnetically formed on the surface of the sleeve 19 by the magnetic force of the roller 20. As the sleeve 19 is rotated, the magnetic brush or developer 21 is moved counterclockwise while spinning due to magnetism.

A scraping body 22 is located at the opposite side to the developing region, i.e., at the rear of the developing sleeve 19. As best shown in FIG. 3, the scraping assembly 22 has a scraper 23 for removing the developer remaining on the sleeve 19 after development. A developer supplying member 24 mixes and agitates the developer removed by the scraper 23 from the sleeve 19 with a fresh toner while scooping them up again toward the sleeve 19. A blade 25 regulates the amount of developer supplied by the member 24 and deposited on the sleeve 19. As shown in FIG. 2, a toner hopper 26 is positioned at the rear end of the casing 18 and loaded with a fresh toner. An agitator 27 is disposed in the toner hopper 26 for agitating the fresh toner, while a toner supply roller 28 is located at the outlet of the toner hopper 26. A doctor blade 29 is spaced apart from the surface of the sleeve 19 by a predetermined gap and serves to regulate the thickness of the developer or brush 21. The excessive amount of developer scraped off by the doctor blade 29 stays and forms a mass in a position upstream of the blade 29 with respect to the direction of rotation of the sleeve 19.

In operation, the agitator 27 in rotation forces the fresh toner in the toner hopper 26 toward the toner supply roller 28 which in turn supplies the toner into the casing 18, a predetermined amount at a time. This toner is mixed and agitated with the developer served development and the excessive developer scraped off by the doctor blade 29 by the scraping body 22. The resulting mixture is scooped up by the scraping member 22 onto the developing sleeve 19 to form the magnetic brush, as will be described later specifically. In this manner, the magnetic brush 21 is transported toward the developing region by the sleeve 19. In this instance, the particles constituting the magnetic brush 21 are agitated and thereby charged due to the spinning motion thereof. The blade 25 of the scraping body 22 and the doctor blade 29 each shaves off the tip of the brush 21 to regulate the amount of the developer to be deposited on the sleeve 19. On reaching the developing region, the brush 21 contacts and develops a latent image having been electrostatically formed on the drum 4. After the development, the scraper 23 of the scraping body 22 removes the remaining developer from the sleeve 19. This part of the developer is sufficiently mixed and agitated with the previously mentioned fresh toner by the rotation of the developer supplying member 24 while being scooped up onto the sleeve 19.

As shown in FIG. 2, a storage implemented as a microcomputer 30 is mounted on the developing unit 6 and loaded with copy process conditions beforehand. For a user who attaches importance or give priority to solid images, for example, the copy process conditions may be of the kind accentuating solid images (e.g. how far the rotation speed of the magnet roller 20 should be increased, as will be described). This is successful in producing an image matching the taste of a particular user.

Figure 4:
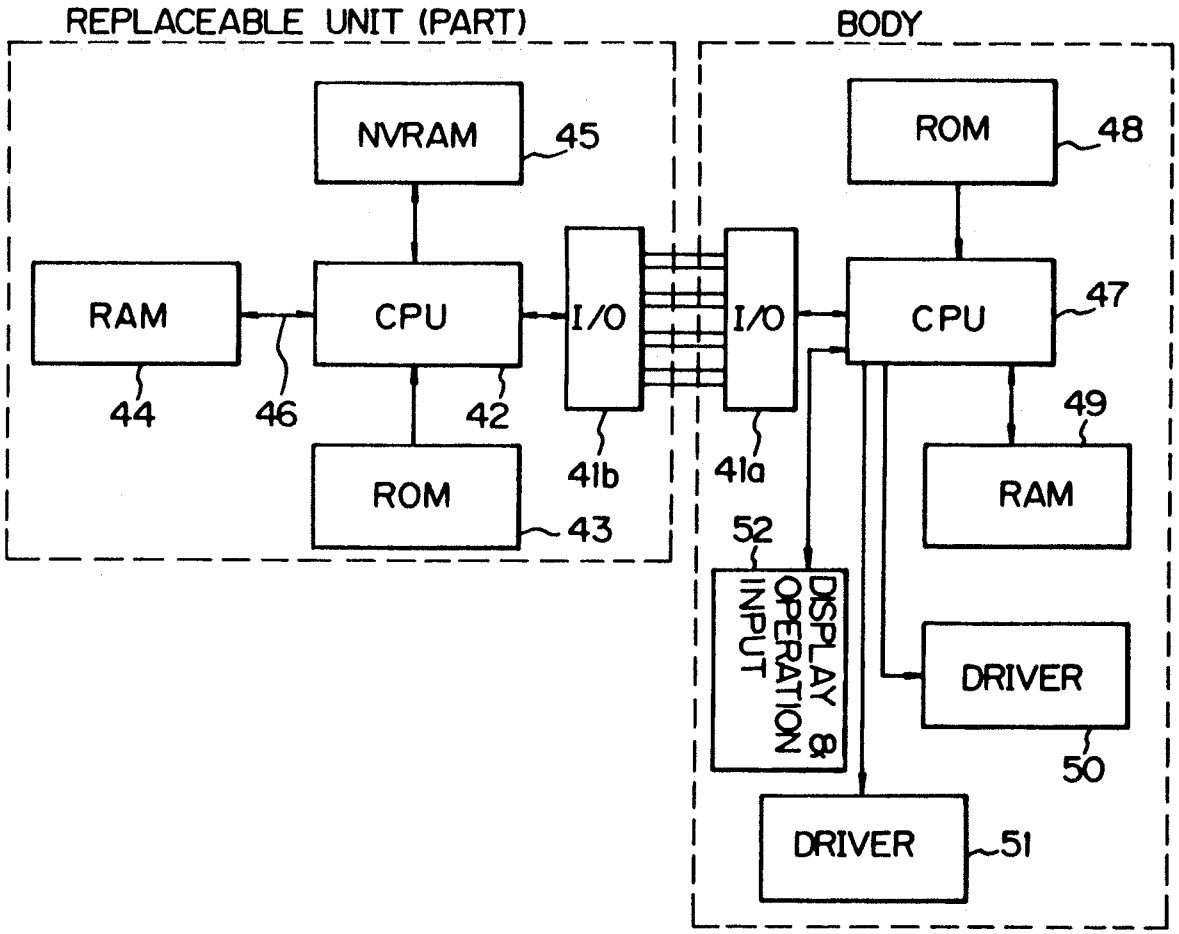
FIG. 4 is a block diagram schematically showing control circuitry partly built in the apparatus body and partly in a replaceable unit.

FIG. 4 shows control circuitry which is partly incorporated in the apparatus body and partly in the replaceable unit (or part). As shown, the apparatus body and the replaceable unit, i.e., the developing unit 6 in the illustrative embodiment are interfaced by I/O ports 41*a* and 41*b*. The circuit part incorporated in the replaceable unit has a CPU 42, a ROM 43, a RAM 44 and a NVRAM 45 which interchange signals over a bus 46.

The circuit part built in the apparatus body has a CPU 47 for controlling units or parts other than the replaceable unit (or part), and a ROM 48 and a RAM 49. The CPU 47 processes data fed thereto from the unit so as to control any one of drivers 50 and 51 that is associated with the input data. At the same time, the CPU 47 controls a display and operation input section 52.

The ROM 43, RAM 44 and NVRAM 45 associated with the replaceable unit or part store various kinds of data for making use of the copy process conditions, results of various kinds of detection, and changes in copying speed (copies per minute or c. p. m) which are particular to the unit or part of interest. Based on such stored data, the CPU 42 delivers commands to the CPU 47 for adequately controlling the individual drivers 50 and 51. The ROM 48 and RAM 49 associated with the apparatus body are not loaded with the above-mentioned data particular to the replaceable unit or part, and they are not commanded (controlled) until they receive data from the replaceable unit or part.

When the operator selects a solid image priority mode by operating a key, not shown, provided on the operation input section 52, a signal indicating that importance is attached to solid images is fed to the CPU 47 and further to the CPU 42 via the I/O ports 41*a* and 41*b*. As a result, a solid image priority mode selection signal is written to the ROM 43, RAM 44 or NVRAM 45. In an arrangement wherein such a signal is written to the ROM 43, the replaceable unit or part will be permanently used as an exclusive unit or part for solid image priority. In another arrangement wherein the signal is written to the RAM 44, the solid image priority mode will be automatically cancelled when the power source is turned off. In still another arrangement wherein the signal is written to the NVRAM 45 (or P-ROM if desired), the user may operate a particular key on the operation board to cancel the solid image priority mode and set up another desired mode (e.g. photograph priority mode or line image priority mode). The CPU 47 performs predetermined arithmetic processing with the signal applied thereto and then feeds a control signal to the driver 50 or 51 to increase the rotation speed of the magnet roller 20, FIG. 2, than in the other modes (e.g. photograph priority mode and line image priority mode). As a result, a greater amount of toner is supplied to produce an image with importance attached to a solid part thereof.

Figure 5:
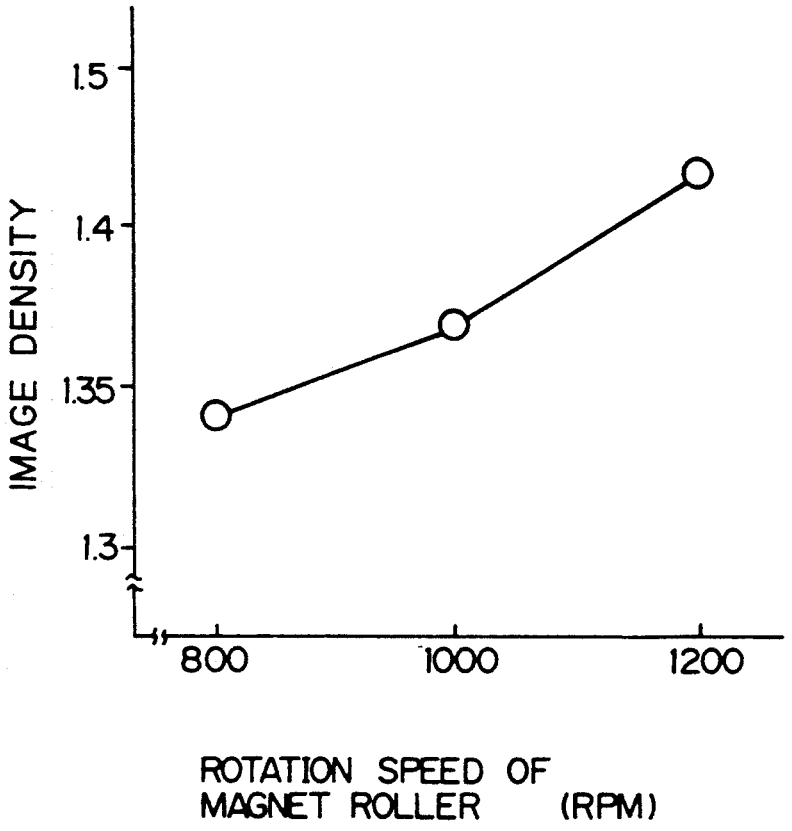
FIG. 5 is a graph showing a relation between the rotation speed of a magnet roller included in the developing unit and the image density.

FIG. 5 shows a relation between the rotation speed of the magnet roller 20 of the developing unit 6 and the image density. As shown, a higher image density is achievable, as in the solid image priority mode, if the rotation speed of the roller 20 is increased. The relations of the individual modes (image densities) to the rotation speed of the roller 20 are measured beforehand and stored. A current trend in the imaging art is toward a multi-function image forming apparatus which forces the body thereof to bear a substantial burden. This, coupled with the ever increasing amount of data to be stored, makes it difficult to assign extra functions to the apparatus body. When the data to be stored are distributed as in the illustrative embodiment, the storage of the apparatus body has only to store data associated with the control over the apparatus body. Program design, therefore, will be provided with extra margins.

While the illustrative embodiment has concentrated on the situation wherein a developing unit to which a particular mode is assigned is set to change the conditions inside of the unit, it is of course possible to change various processing conditions such as the charging, exposing and fixing conditions by setting a developing unit having a particular mode. In this manner, storages each storing copy process conditions matching a line priority mode, photograph priority mode, tone priority mode or any other similar mode may be prepared to process an image to the user's taste. The replaceable unit or part provided with the storage and controller as stated above is capable not only of processing an image to the user's taste but also of detecting various factors such as the service life thereof, functions, toner end, color, and anti-compatibility. In addition, it is capable of effecting control over the copying speed (c.p.m).

Figure 6:
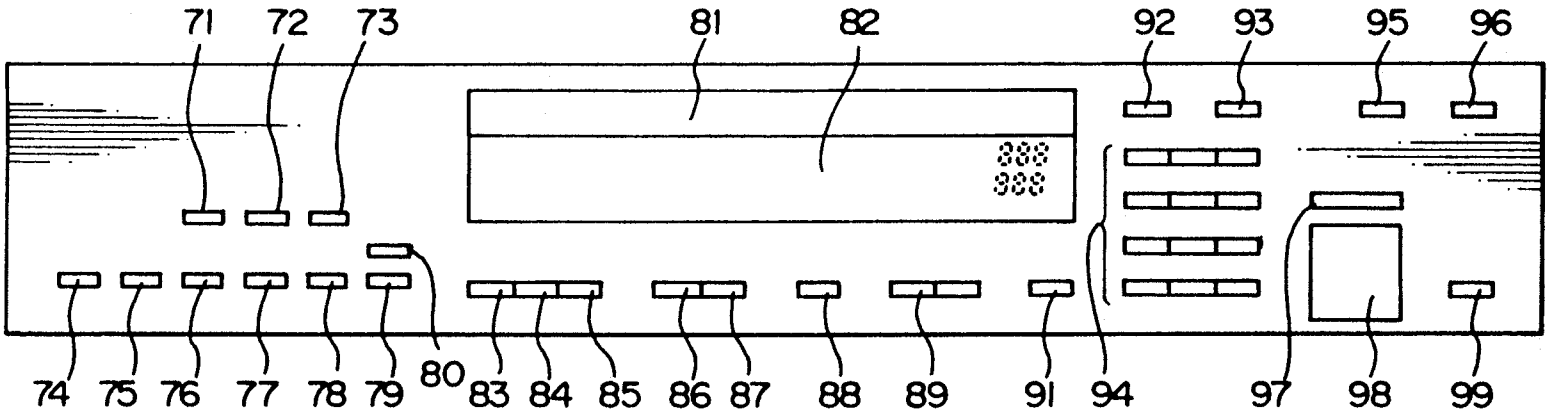
FIG. 6 is an enlarged plan view of a display and operation input section.

FIG. 6 depicts a specific arrangement of the display and operation input section 52. As shown, the display and operation input section 52 has a margin adjust key 71, a center key 72, a dimensional magnification change key 73, a sorter key 74, a two-sided copy key 75, a continuous page copy key 76, a delete key 77, a paper size magnification change key 78, a zoom-down key 79, a zoom-up key 80, a guidance display 81, a display panel 82, a reduce key 83, an enlarge key 84, a 1:1 key 85, a paper select key 86, an automatic paper select key 87, a DTM select key 88, a density adjust key 89, an automatic density key 91, a guidance key 92, an enter key 93, numeral keys 94, a program key 95, a timer key 96, an interrupt key 97, a start key 98, and a mode clear/-preheat key 99.

Figure 7:
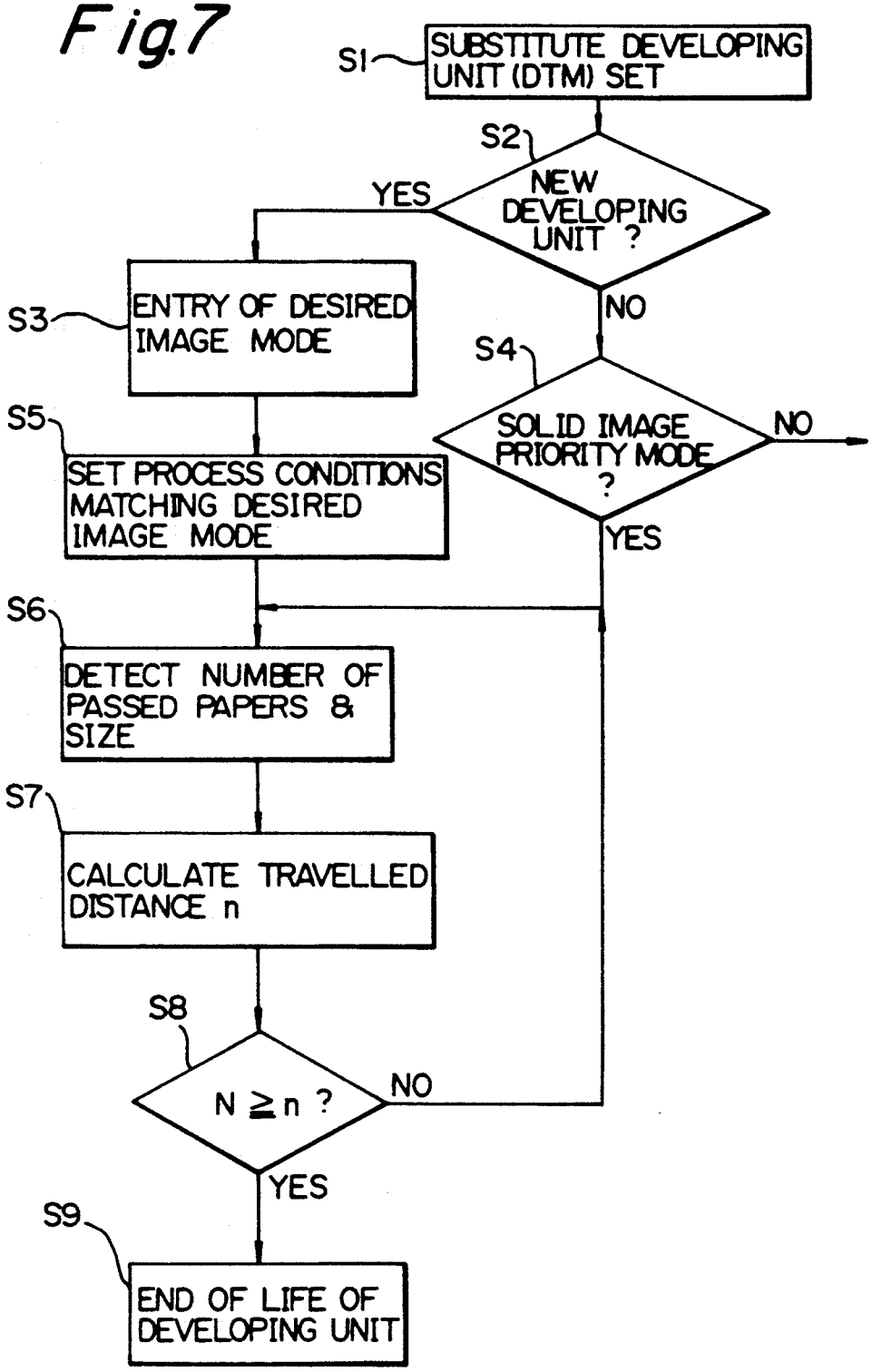
FIG. 7 is a flow chart of control associated with the solid image priority mode.

FIG. 7 shows the control associated with the solid image priority mode. Steps S1 to S9 shown in the figure are representative of the following operations.

Step S1: A substitute developing unit is set;

Step S2: whether or no the substitute developing unit is new is determined. If the answer is YES, the program advances to a step S3. If otherwise, a step S4 is executed;

Step S3: A desired image mode is selected and entered (solid image priority mode in the illustrative embodiment);

Step S4: whether or not the solid image priority mode has been selected is determined. If the answer is YES, a step S6 is executed while, if otherwise, the operation is transferred to another flow;

S5: After the desired image mode has been entered in the step S3, process conditions (e.g. rotation speed of the magnet roller 20, potential of the drum 4, and gamma characteristic of the drum 4) matching the mode are set up, followed by an ordinary copying cycle;

Step S6: The number of passed paper sheets and the sizes thereof are determined;

Step S7: The number of passed sheets and the paper sizes are multiplied to produce a distance n which the paper sheets travelled;

Step S8: The service life of the replaceble unit (developing unit in the illustrative embodiment) is predetermined as a total paper travel distance N. Whether or not the current distance n is equal to the total distance N is determined. If the answer is NO, the program returns to the Step S6; and Step S9: If the answer of the step S8 is YES, the program determines that the life of the unit has expired and delivers an end-of-life signal to inhibit further operations of the apparatus.

SECOND EMBODIMENT

Figure 8:
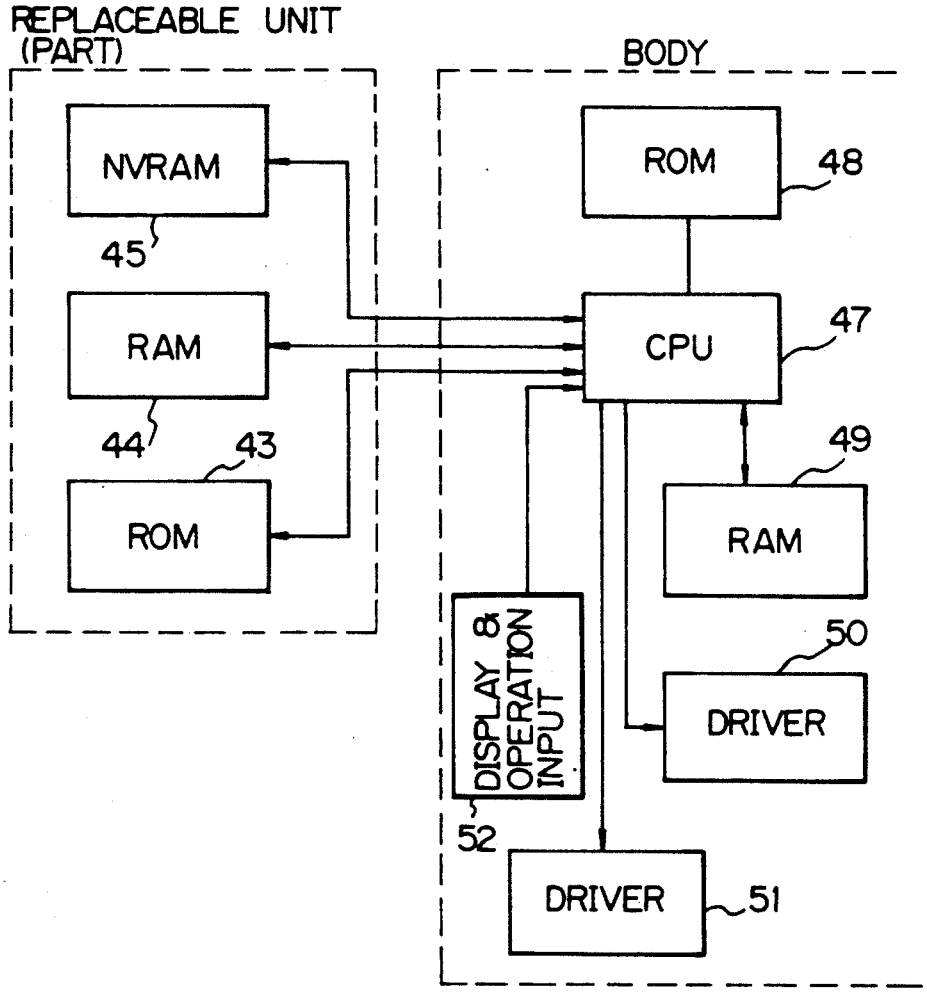
FIG. 8 is a block diagram schematically showing control circuitry representative of a second embodiment of the present invention and distributed to an apparatus body and a replaceable unit.

Referring to FIG. 8, there is shown control circuitry partly built in an apparatus body and partly in a replaceable unit or part and representative of an alternative embodiment of the present invention. As shown, the replaceable unit or part has the ROM 43, RAM 44, and NVRAM 45. The apparatus body has the CPU 47 for controlling replaceable units or parts other than the unit or part of interest, and ROM 48 and RAM 49. Data from the replaceable unit or part is processed by the CPU 47 to control the associated driver 50 or 51. At the same time, CPU 47 displays the data. The circuit parts associated with the apparatus body and replaceable unit are interconnected by a connector, not shown, for example. This particular embodiment is practicable with a low cost because the circuit part of the replaceable unit does not need a CPU and similar components.

THIRD EMBODIMENT

In the first and second embodiments shown and described, the storage of a replaceable unit or part is loaded beforehand with data for making use of the process conditions particular to the unit or part, various kinds of detection, and changes in the copying speed (c.p.m). The present invention is not limited to such a configuration. In a third embodiment, the storage of a replaceable unit or part is not loaded with any of the above-mentioned kinds of data. Specifically, such data for using the replaceable unit or part are stored in the storage of the apparatus body beforehand. Then, the user may select desired data on the operation board and thereby determine the conditions in which the replaceable unit or part will be used. The so determined conditions of use are written to the storage of the apparatus body. In this instance, the data may be written to the replaceable unit or part either temporarily or permanently. The storage of the apparatus body stores process conditions, various kinds of detection, data for changing the copying speed (c.p.m) in various patterns. As the user selects particular ones of such data and thereby the conditions of use of the replaceable unit or part, the replaceable unit or part is allowed to operate or function.

FOURTH EMBODIMENT

Figure 9:
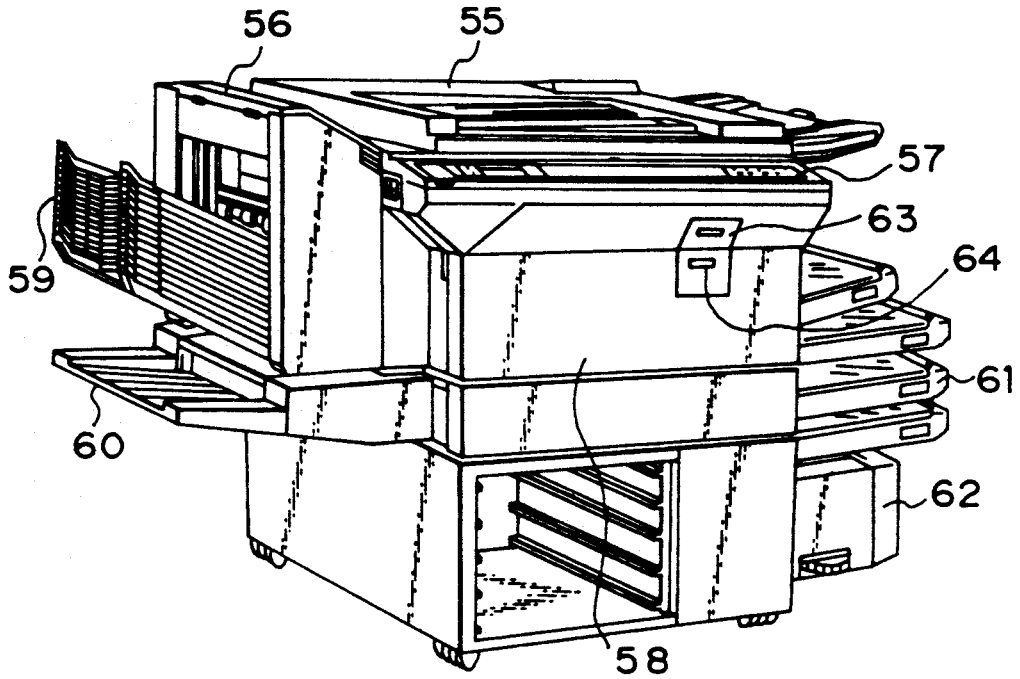
FIG. 9 is a perspective view of an image forming apparatus with which fourth embodiment of the present invention is practicable.

Referring to FIG. 9, another alternative embodiment of the present invention is shown and has an automatic document feeder (ADF) 55, a sorter 56, a display and operation input section 57, an apparatus body 58, a copy tray 59, an automatic two-side unit 60, paper cassettes 61, a paper feed tray 62, a unit cover 63 covering a replaceable unit which is set in the apparatus body 58, and an opening 64 formed in the unit cover 63. In this particular embodiment, the replaceable unit lacks a storage, while use is made of a magnetic card, IC card, optical card or similar external storage, not shown, for storing copy process conditions and other data. Specifically, such an external storage is inserted into the replaceable unit via the opening 64. In this condition, the replaceable unit and the external storage are interconnected by a connector, not shown.

In the foregoing embodiments, the developing unit has been assumed to be replaceable and to adjust the rotation speed of the magnet roller 20 thereof in matching relation to a desired mode. This is only illustrative and not restrictive. For example, the replaceable unit may be a cleaning unit, a photoconductive drum, or a fixing unit. Adjustable factors of such alternative units will be enumerated below. It is to be noted that the number of adjustable factors may be one or may be suitably changed to attain a more desirable image.

a. Replacement of developing unit:
(1) rotation speed of magnet roller in the unit
(2) surface potential of drum in the unit
(3) amount of toner supply in the unit
(4) threshold value of density sensor in the unit
(5) developing bias
(6) quantity of exposing light
(7) degree of matching of the unit to apparatus body
b. Replacement of cleaning unit
(1) rotation speed of brush in the unit
(2) voltage control over charger unit
(3) blade pressure
(4) precleaning voltage
(5) life of the unit
(6) compatibility of the unit
(7) degree of matching of the unit to apparatus body
c. Replacement of photoconductive drum
(1) characteristics of the drum
(2) degree of matching of the drum to apparatus body
(3) life of the drum
d. Replacement of fixing unit
(1) temperature matching developing conditions, e.g. kind of toner
(2) life of the unit
(3) degree of matching of the unit to apparatus body
e. Replacement of toner cartridge
(1) kind of the cartridge
(2) remaining amount of toner
(3) life of the cartridge
(4) degree of matching of cartridge to apparatus body.

FIFTH EMBODIMENT

Figure 10:
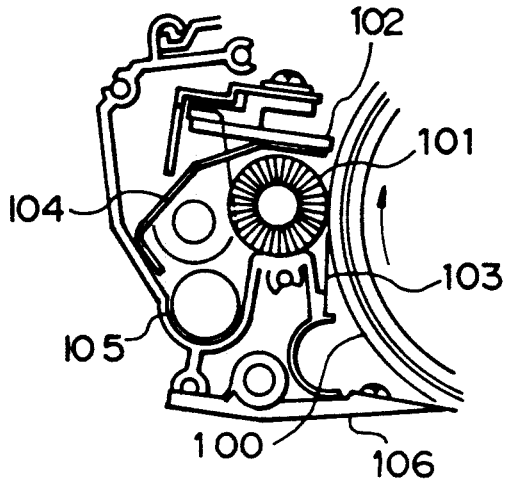
FIG. 10 is a section showing a cleaning unit.
Figure 11:
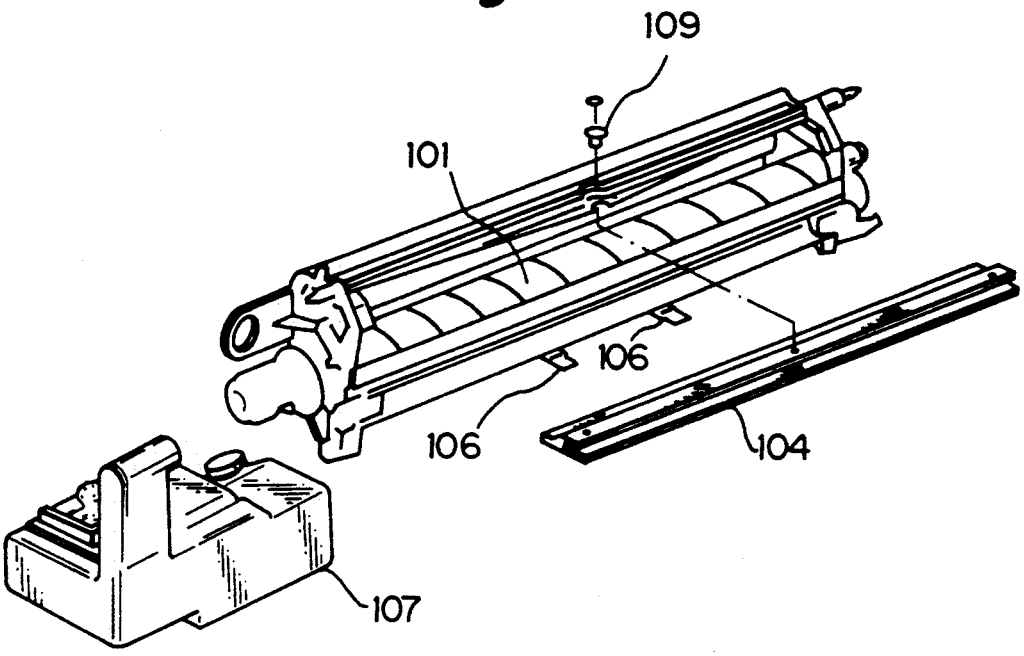
FIG. 11 is an exploded perspective view of the cleaning unit.
Figure 12:
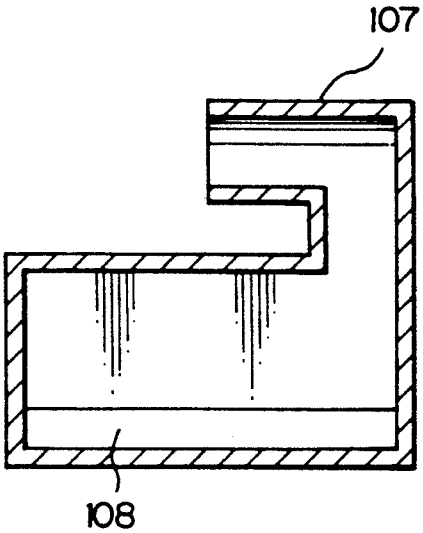
FIG. 12 is a section of a toner bottle.

A fifth embodiment is essentially the same as the first embodiment, FIGS. 1 to 4, concerning the general construction of the apparatus, the construction and functions of the developing unit, and the control circuitry distributed to the apparatus body and the replaceable unit. Referring to FIGS. 10 to 12, there are shown a photoconductive drum 100, a fur brush 101, a cleaning blade 102, an inlet seal 103, a blade cleaner 104, a toner collecting coil 105, a separator pawl 106, a toner collecting bottle 107, a weight sensor 108, and a screw 109.

As shown in FIGS. 10 and 11, toner particles remaining on the drum 100 after image transfer are removed by the fur brush 101 and cleaning blade 102. The cleaning blade 102 is supported at one point thereof so that a uniform pressure distribution may be set up along the length thereof. The fur brush 101 is rotatable in the same direction as the drum 100 to remove paper dust and other impurities which are not easy to remove with the blade 102 alone. The toner scraped off by the fur brush 102 and cleaning blade 102 is driven out of the cleaning section by the toner collecting coil 105 and then collected in the bottle 107. As shown in FIG. 12, the weight sensor 108 is affixed to the bottom of the bottle 107 for sensing the weight of the collected toner. Even when an exclusive DTM for a solid image priority mode is used first and then replaced with an exclusive DTM for a line image priority mode, the total amount of toner having been discharged from the former is memorized. Hence, when the DTM adapted for solid images is mounted on the apparatus body again, the amount of toner to be discharged will be added to the previous total amount of discharge. The storage of the apparatus body stores various kinds of data and allows the user to set up the funtions of the DTM by selecting desired conditions. A DTM is rendered operative on receiving data from the apparatus body.

The illustrative embodiment senses the life of a DTM. Assume that DTMs for solid images and line images are available. Since the DTMs for solid images and line images are mainly used to develop respectively solid images and line images, they are different from each other with respect to the amount of toner collected in the cleaning unit. As shown in Table 1 below, the total amounts of waste toner at which the life of the solid image DTM and that of the line image DTM expire are assumed to be $W_1$ and $W_2$, respectively. These data are stored in a storage, or life memory, of the apparatus body.

TABLE 1

| MODE | WASTE TONER AMOUNT REPRESENTING LIFE |
|---|---|
| SOLID IMAGE DTM | $W_1$ |
| LINE IMAGE DTM | $W_2$ |

Figure 13:
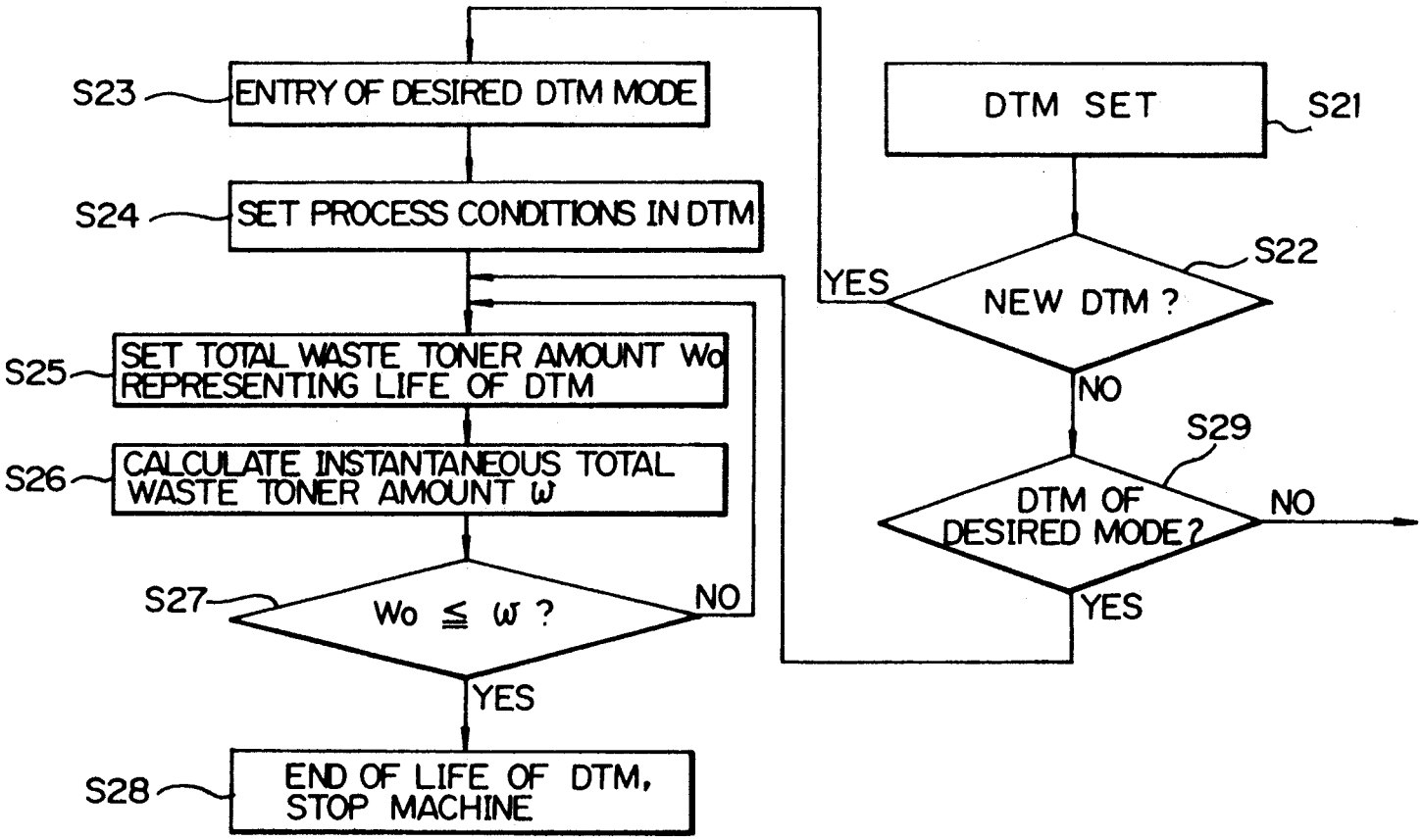
FIG. 13 is a flowchart demonstrating a specific operation of the fourth embodiment.

FIG. 13 is a flowchart demonstrating a specific operation of the illustrative embodiment. As shown, when a DTM is set (step S21), whether or not the DTM is new is determined (step S22). If the answer of the step S22 is YES, a desired image mode such as a solid image priority mode is entered (step S23). Thereafter, particular process conditions such as a sleeve rotation sleeve and a magnet rotation speed are inputted to the DTM (step S24). A total amount of waste toner Wo representative of the life of the DTM is set (step S25). The total amount of waste toner Wo corresponds to the data associated with the life and the number of times that an image forming operation is repeated. The weight sensor 107 and a counter built in the CPU cooperate to determine the instantaneous total amount of waste toner w (step S26). A comparator also built in the CPU compares Wo and w (step S27). If w is equal to or greater than Wo, the program inhibits further operations of the machine determining that the life of the DTM has expired (step S28). If the answer of the step S22 is NO, whether or not the DTM operable in the desired image mode is determined (step S29). If the answer of the step S29 is YES, the program advances to a step S25; if otherwise, the operation is transferred to another mode (such as when use is made of a line image DTM).

SIXTH EMBODIMENT

Another alternative embodiment which will be described is characterized in that the data associated with the life and the data associated with the number of image forming operations performed are implemented as the rotation speed of a rotary member included in a DTM or any other rotary member. Assume that a solid image DTM and a line image DTM are available. It is known beforehand that the solid image DTM has a life corresponding to a copies for A4, 25% documents while the line image DTM has a life corresponding to b copies for A4, 7% documents. Such data are stored in a storage, life memory, built in the apparatus body. As the user loads the apparatus body with a solid image DTM and then enters it on the operation board, the life $a \cdot n = N_1$ of the solid image DTM is fed from the life memory of the apparatus body to the solid image DTM. It is to be noted that n is the rotation speed of the developing sleeve per copy.

TABLE 2

| MODE | COPIES REPRESENTING LIFE | AGED RATIO OF DOCUMENT IMAGE | DATA |
|---|---|---|---|
| SOLID IMAGE DTM | a copies | A4, 25% DOCUMENT | $a \cdot n = N_1$ |
| LINE IMAGE DTM | b copies | A4, 7% DOCUMENT | $a \cdot n = N_2$ |

Figure 14:
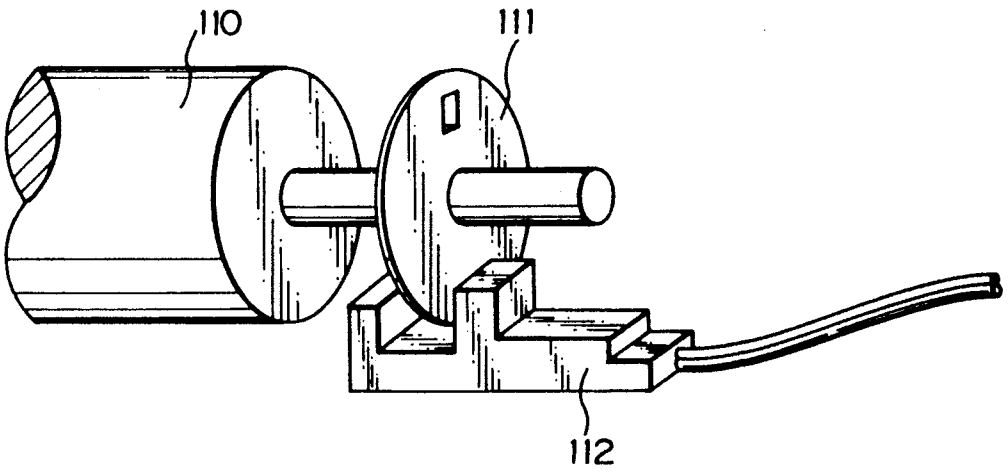
FIG. 14 is a perspective view of a sensor.

FIG. 14 shows a sensor with which this particular embodiment is practicable. In the figure, there is shown a developing sleeve 110, a pulse generator 111 rotatable integrally with the sleeve 110, and a rotation sensor 112. Since n rotations of the developing sleeve 110 corresponds to one copy, the number of copies corresponding to the life is counted in terms of the output of the rotation sensor 112 which counts the rotations of the pulse generator 111. Even when a solid image DTM is used first and then replaced with a line image DTM, how many copies have been produced with the solid image DTM is memorized. Hence, when the solid image DTM is mounted on the apparatus body again, the count will sequentially increase from the last count.

While the illustrative embodiment counts the number of rotations of the developing sleeve 110, it may count the number of rotations of a toner supply roller or that of an agitator or even that of a rotary member included in the apparatus body, e.g. a roller of a fixing unit. The term "number of rotations" refers to the number as counted within a period of time associated with an image portion, and for this purpose use may be made of the timings at which a developing bias is applied to the developing unit.

Figure 15:
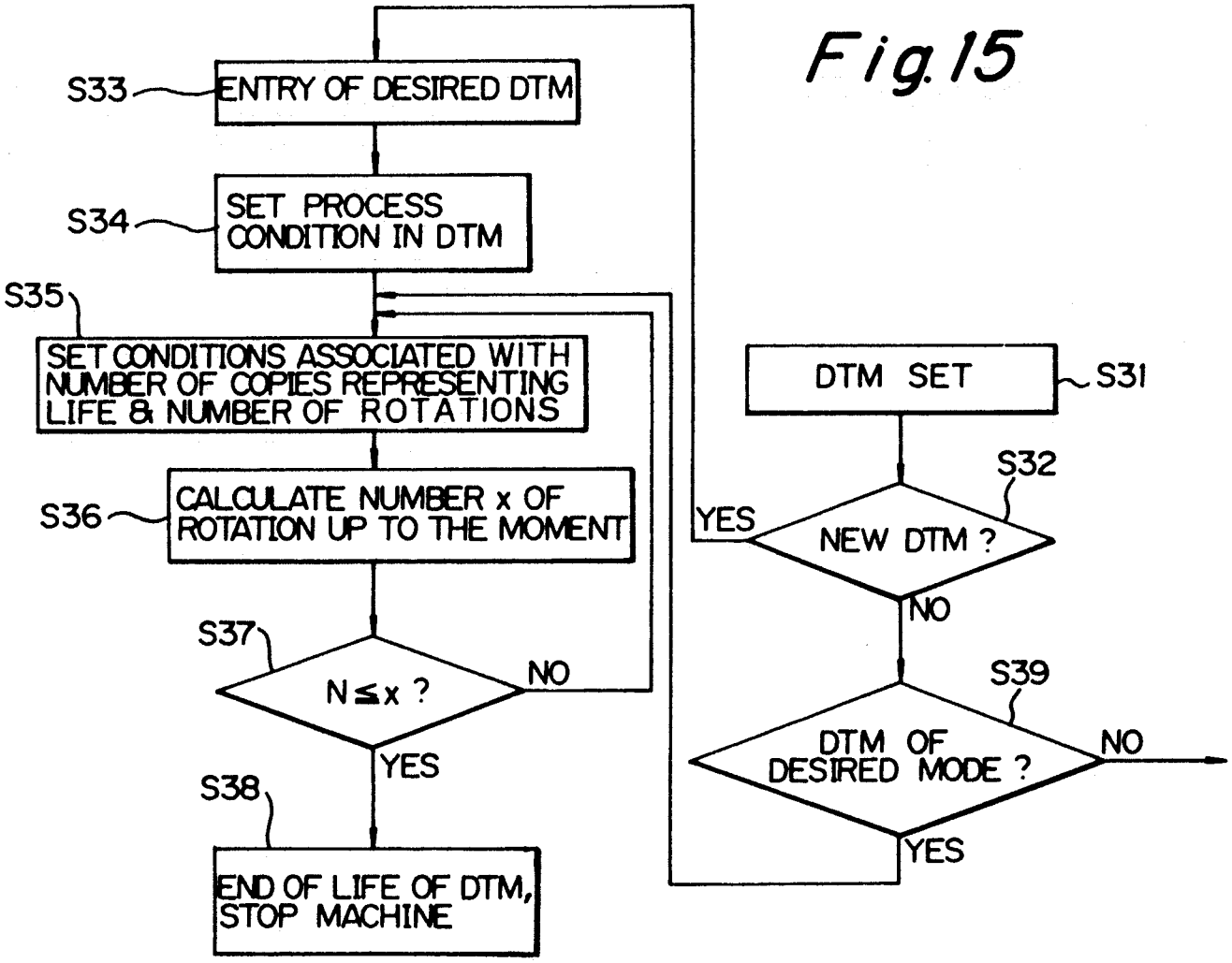
FIG. 15 is a flowchart representative of a specific operation which is based on the rotation speed.

FIG. 15 shows a specific operation of this particular embodiment. As shown, when a DTM is set (step S31), whether it is new is determined (step S32). If the answer of the step S32 is YES, a desired DTM mode such as a solid image DTM mode is entered (step S33). Thereafter, process conditions such as the number of rotations of the sleeve and that of the magnet roller are applied to the DTM (step S34). This is followed by setting up the number of copies X and the number of rotations particular to each mode (step S35). Then, the number of rotations x having occurred, i.e., how many copies have been produced is determined (step S36) and compared with the total number of rotations N representative of the life (step S37). If x is equal to or greater than N, the program interrupts the operation of the machine determining that the life of the DTM of interest has expired (step S38). On the other hand, if the answer of the step S32 is NO, whether or not the DTM is of the kind corresponding to the desired mode is determined (step S39). If the answer of the step S39 is YES, the step S35 is executed; if otherwise, the operation is transferred to another flow (e.g. in the case of a line image DTM).

SEVENTH EMBODIMENT

In this particular embodiment, the data associated with the life and the data associated with the number of image forming operations performed are implemented as a distance travelled by a scanner included in optics. A solid image DTM and a line image DTM are different from each other with respect to the amount of toner consumption, i.e. life. Hence, as shown in Table 3 below, the total scanning distances associated with the life of a solid image DTM and that of a line image DTM are $L_1$ and $L_2$, respectively. These data are stored in a life memory built in the apparatus body. As the user loads the apparatus body with a solid image DTM and then enters it on the operation board, the scanning distance $L_1$ representative of the life of a solid image DTM is transferred from the life memory of the apparatus body to the memory of the DTM.

TABLE 3

| MODE | SCAN DISTANCE REPRESENTING LIFE | SCAN DISTANCE: l |
|---|---|---|
| SOLID IMAGE DTM | $L_1$ | $l = \Sigma (v_1t + v_2t)$ |
| LINE IMAGE DTM | $L_2$ | |

Figure 16:
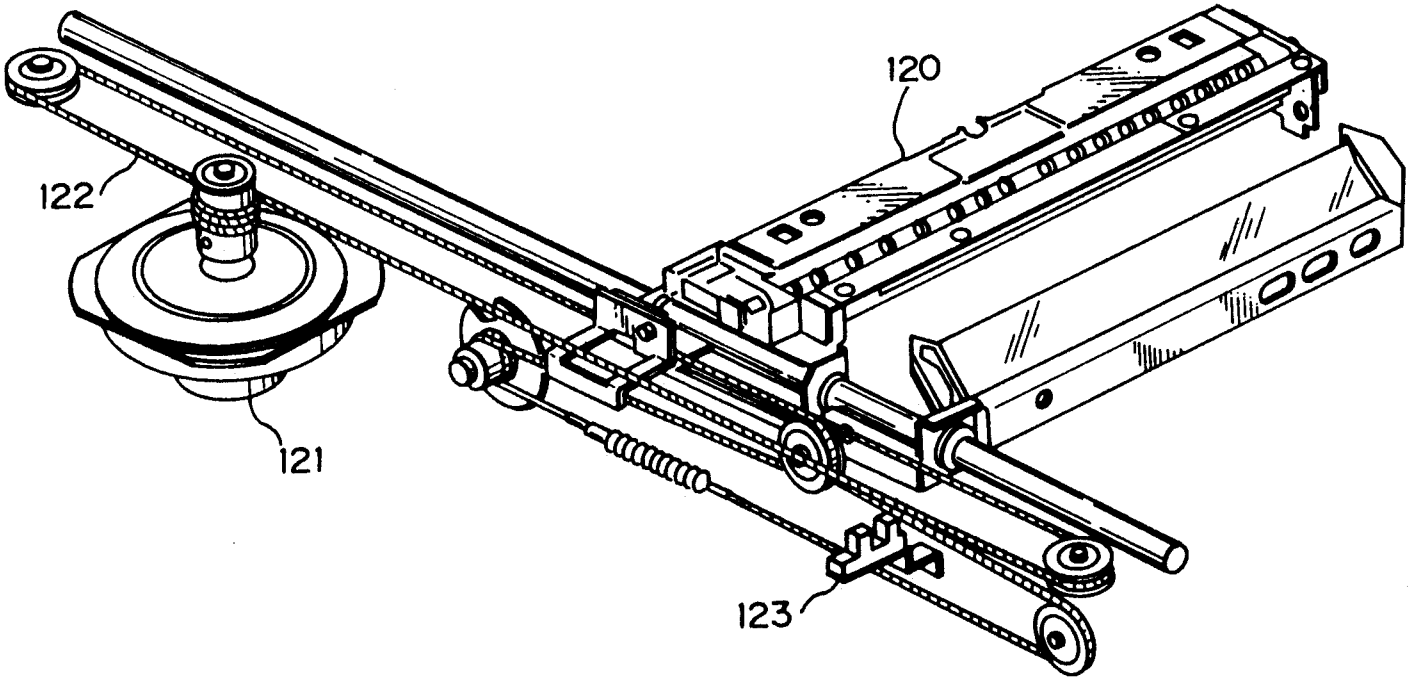
FIG. 16 is a perspective view of a scanner home position sensor.

FIG. 16 show a scanner 120, a scanner motor 121, a scanner wire 122, and a scanner home position (HP) sensor 123 with which the illustrative embodiment is practicable. In the figure, the DTM counts the scanning distance by detecting the document size, determining whether the scanning speed is for size A3 or for size A4 and thereby setting a scanning speed, detecting the period of time t necessary for the scanner 120 to move away from and return to the HP sensor 123, multiplying the scanning speed and the time t to produce a scanning distance, and then adding the scanning distance to the last scanning distance. The term "scanning time" refers to a time as measured in a portion corresponding to an image portion and may be synchronous with the operation timing at which a developing bias is applied.

Figure 17:
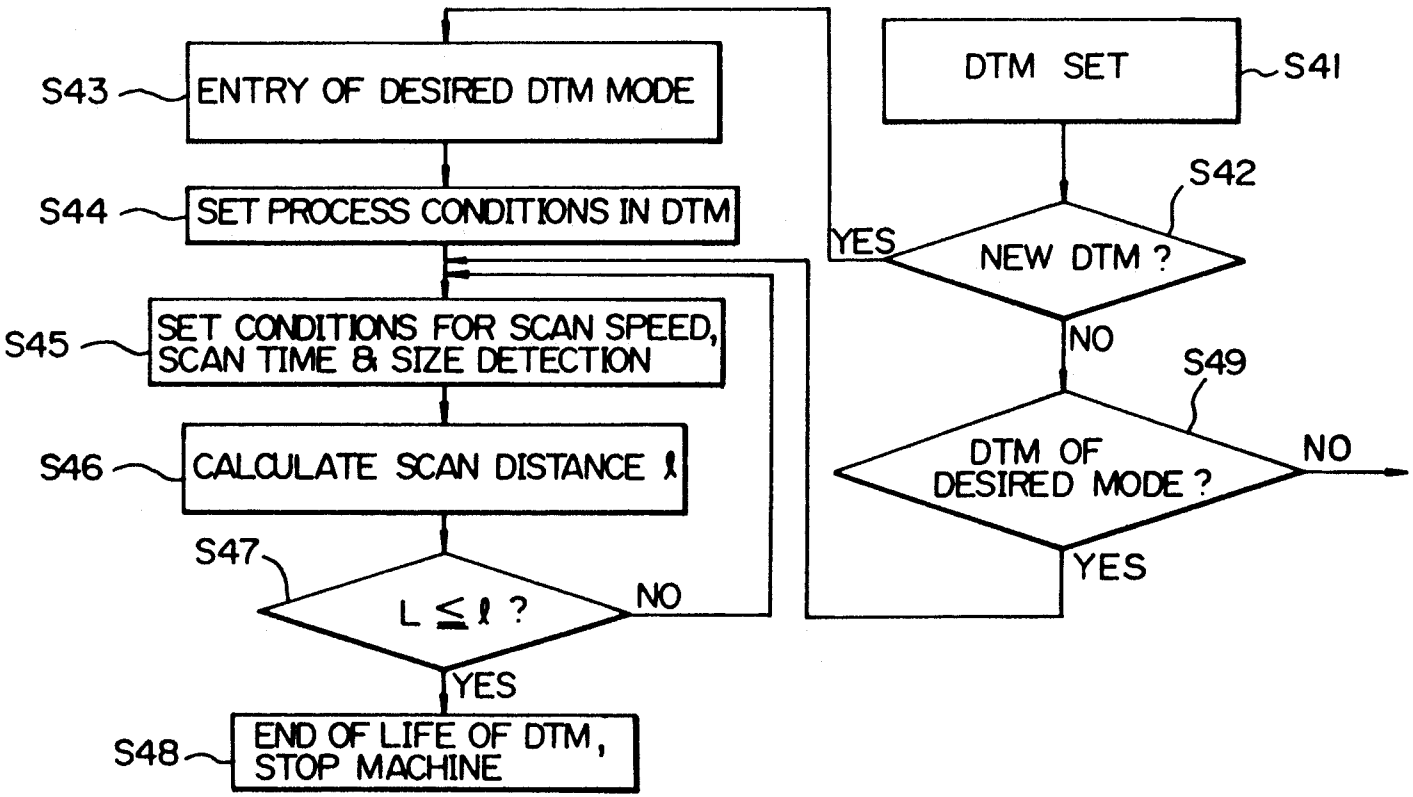
FIG. 17 is a flowchart showing a specific operation based on the scanning distance.

FIG. 17 is a flowchart demonstrating a specific operation of the seventh embodiment. When a DTM is set (step S41), whether or not the DTM is new is determined (step S42). If the answer of the step S42 is YES, a desired DTM mode is entered (step S43) and process conditions associated therewith are inputted to the DTM (step S44). At this time, conditions for detecting the scanning speed, scanning time and size are set (step S45). The scanning speed and the scanning time are multiplied to produce the scanning distance l having been travelled (step S46). The produced scanning distance l is compared with a predetermined total scanning distance L representative of the life (step S47). If the intantaneous distance l is equal to or greater than the total distance L, the program inhibits further operations of the machine determining that the life of the DTM in use has expired (step S48). If the answer of the step S42 is NO, whether or not the kind of the DTM corresponds to the desired mode is determined (step S44). If the answer of the step S44 is YES, the step S45 is executed; if otherwise, the operation is transferred to another flow.

EIGHTH EMBODIMENT

Figure 18:
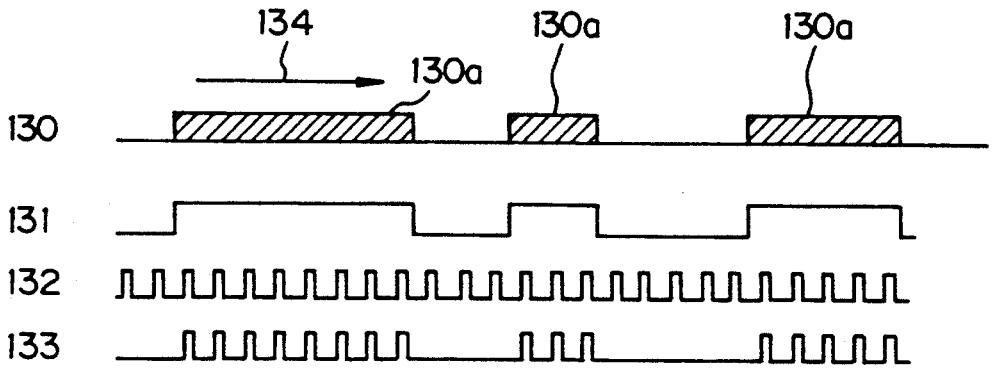
FIG. 18 shows a specific waveform of an image signal.

This embodiment also detects the life of a DTM and is practicable with the general construction shown in FIG. 1. Referring to FIG. 18, there is shown the waveforms useful for understanding this embodiment, i.e., a developed image 130, an image signal 131, reference pulses 132, and integrated pulses. An arrow 134 shown in the figure indicates the main scanning direction. While the image 130 is produced by scanning which is effected in the main scanning direction 134, the image signal 131 may be generated by repeating main scanning a plurality of times. Further, the image 130 may be produced by modulating a semiconductor laser (LD) by the image signal 131 and repetitively outputting the image signal 131 over a suitable subscanning time. The toner is actually consumed at black portions 130*a* included in the image 130 and where the image signal is at a high level or "H". It follows that integrating the "H" portions of the image signal 131 is successful in determining the degree of consumption of the toner (corresponding to the number of image forming operations performed which is dependent on the copy mode). The reference pulses 132 have to be implemented by a clock whose rate is higher than that of the image signal 131. The image signal 131 and reference pulses 132 are ANDed to obtain the integrated pulses 133. The integrated pulses 133 are counted to integrate the "H" portions of the image signal 131.

An image signal S is expressed as:

$$S = v \times t$$

where v is the speed at which a polygonal mirror scans a photoconductive drum, and t is the period of the reference pulses 132.

The duration of "H" levels of the image signal S is equal to the scanned area on the photoconductive drum, with no regard to the rotation speed of the polygon mirror. Stated another way, it is the total area of black lines which are represented by the image 130. By providing the reference pulses 132 with a stable period, it is possible to count the reference pulses 132 without being effected by the scanning speed of the polygon mirror. Such an operation will be insured so long as the reference pulses 132 have a high frequency.

Figure 19:
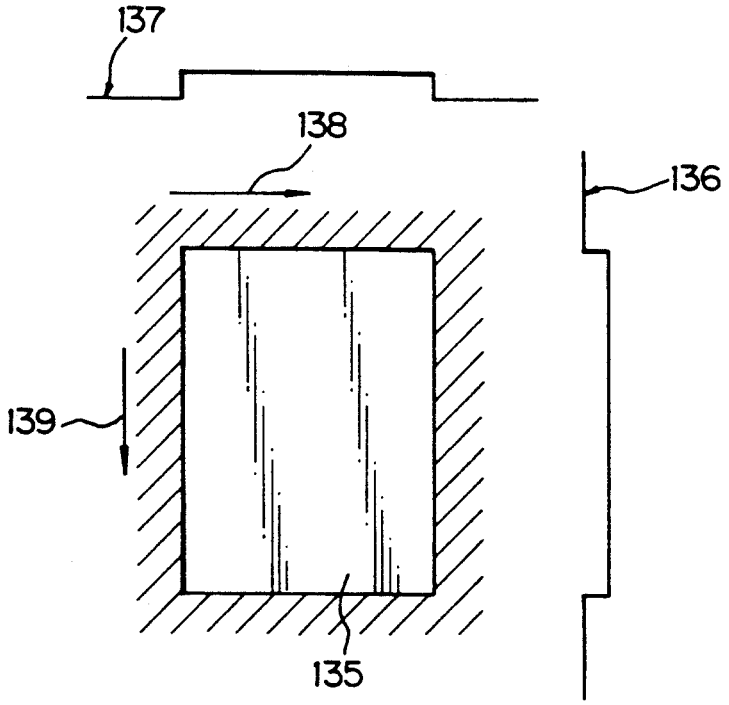
FIG. 19 is a view useful for understanding an effective image area.

An effective image area will be described with reference to FIG. 19. In FIG. 19, there is shown an effective image area 135, an effective vertical image width 136, an effective horizontal image width 137, a main scanning direction 138, and a widthwise direction 139. The effective image area 135 is variable with the paper size and an effective image area which the user may desire. Assume that the signal is "H" in the effective image area 135 while it is low or "L", i.e., toner consumption is small in the other area. ANDing the vertical and horizontal effective image widths 136 and 136 provides the effective image area 135. In the area other than the effective image area 135, a toner has to be prevented from depositing by one method or another. Then, by using the vertical and horizontal effective image widths 136 and 137, the toner is prevented from being consumed by the image signal 131 in the area other than the effective image area 135. This allows the toner consumption to be confirmed with accuracy.

As stated above, the image signal 131 and reference pulses 132 are ANDed to produce the integrated pulses 133. When the integrated pulses 133 appear, the LD is turned on and the developing operation is effected to deposit the toner on the drum. The principle described above is also applicable to an apparatus of the type which causes a toner to deposit when an LD is turned off.

Figure 20:
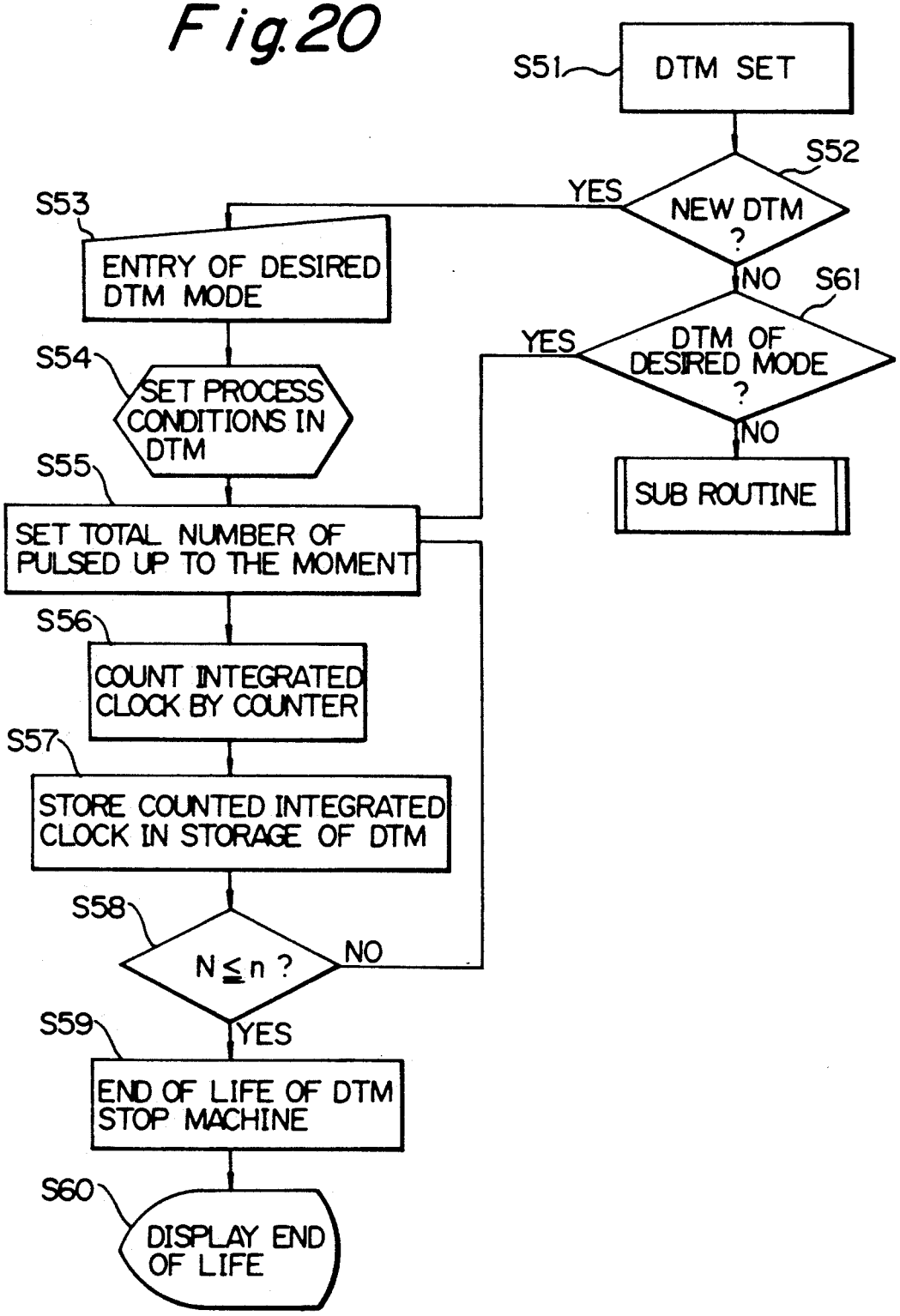
FIG. 20 is a flowchart showing a specific operation based on black portions of an image.

FIG. 20 is a flowchart showing a specific operation of the illustrative embodiment. As shown, as a DTM is set (step S51), whether or not it is new is determined (step S52). If the answer of the step S52 is YES, a desired DTM mode such as a solid image DTM mode is entered (step S53). Then, process conditions such as the rotation speed of the sleeve and that of the magnet are written to the DTM (step S54). The total number of pulses N having appeared in the past and relating to the life of the DTM is set (step S55). An AND gate, not shown, built in the CPU of the apparatus body ANDs data representative of the vertical and horizontal effective image width 136 and 137 which are based on the image signal 131, reference pulses 132 and paper size, whereby an integrated clock is generated. The integrated clock is counted by an electric counter (step S56), while the count is stored in a memory included in the DTM (step S57). The total number of pulses n of the DTM and the predetermined total number of pulses (number of life pulses) N are compared by a comparator included in the CPU (step S58). If $\eta$ is equal to or greater than N, the program interrupts the operation of the machine determining that the life of the DTM has expired (step S59). At the same time, the CPU shows such a condition on a display (step S60). If the answer of the step S52 is NO, whether or not the DTM of interest is operable in the desired mode is determined (step S61). If the answer of the step S61 is YES, the operation is transferred to the step S55; if otherwise, it is transferred to another subroutine (e.g. line image mode or photograph mode).

If desired, the period in which the black portions of the image signal, or data relating to the life, appears may replace the image area S determined by the previous equation and may be used as reference data for life detection.

Figure 21:
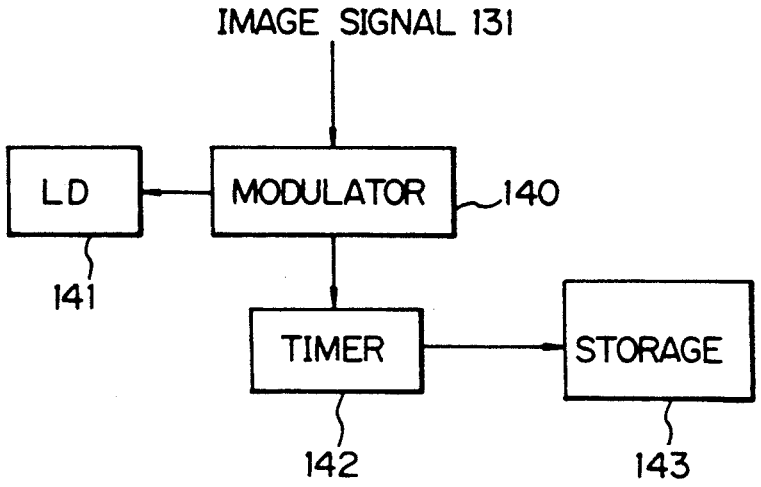
FIG. 21 is a block diagram schematically showing a semiconductor laser (LD) control circuit.

FIG. 21 shows a specific construction of a LD drive circuit particular to this embodiment. As shown, a modulator 140 modulates the image signal 131 on a LD drive board, so that the LD 141 writes a latent image on a photoconductive drum. A timer (counter) 142 counts the duration of the signal being imputted to the modulator 140 (current feeding time), and the count is written to a memory 143. The current feeding time corresponds to the duration of a black level of the image signal 131. The total current feeding time may be used as a reference for life detection. Specifically, a predetermined total current feeding time associated with process conditions of a DTM and the actual total current feeding time of the DTM may be compared for the purpose of detecting the life of the DTM.

Figure 22:
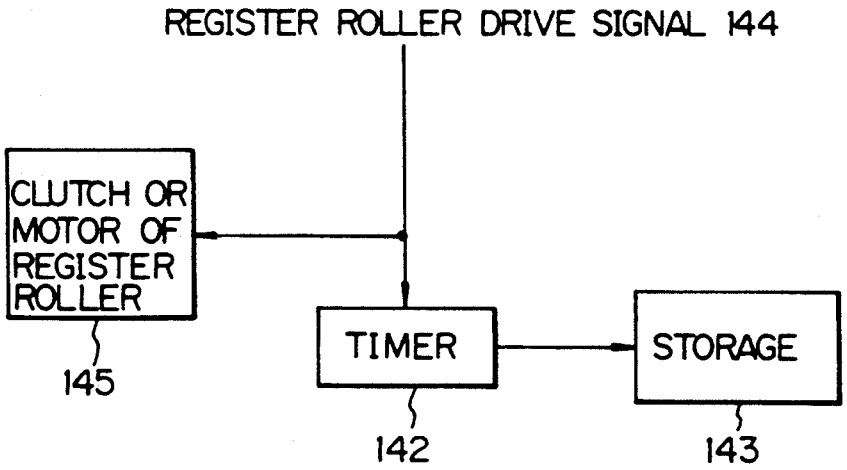
FIG. 22 is a block diagram schematically showing a signal detection system incorporated in an analog copier.

Assume that the image signal cannot be read as with an analog copier. Then, as shown in FIG. 22, when a register roller drive signal 144 is fed from the apparatus body to a DTM, a clutch or motor 145 associated with a register roller is turned on to drive a paper sheet. Hence, an arrangement may be made such that a timer (counter) 142 counts the ON time of the register roller drive signal 144 while the count is written to a memory 143 built in the DTM, the total current feeding time being used as a reference for life detection.

Figure 23:
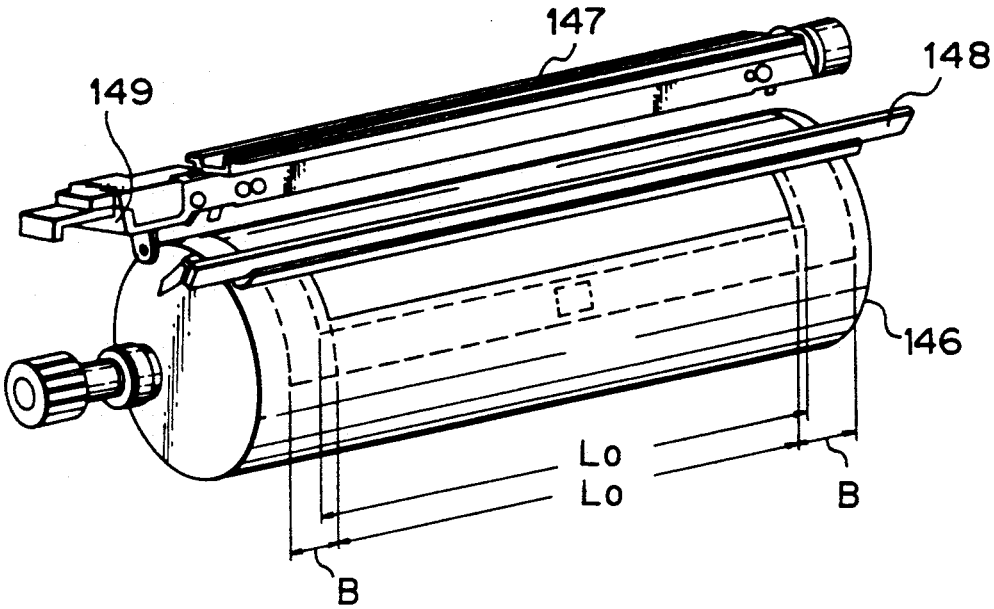
FIG. 23 is a perspective view of a photoconductive drum and neighborhood thereof.

FIG. 23 shows a photoconductive drum 146 and its associated arrangement. Specifically, there are shown a charger unit 147, an eraser 148, and an end block 149. A document is assumed to have a width $L_0$, while side erasure is assumed to be effected over a width B at opposite ends of the drum 149. Hence, the sum of $L_0$ and 2B is the charging width.

Figure 24:
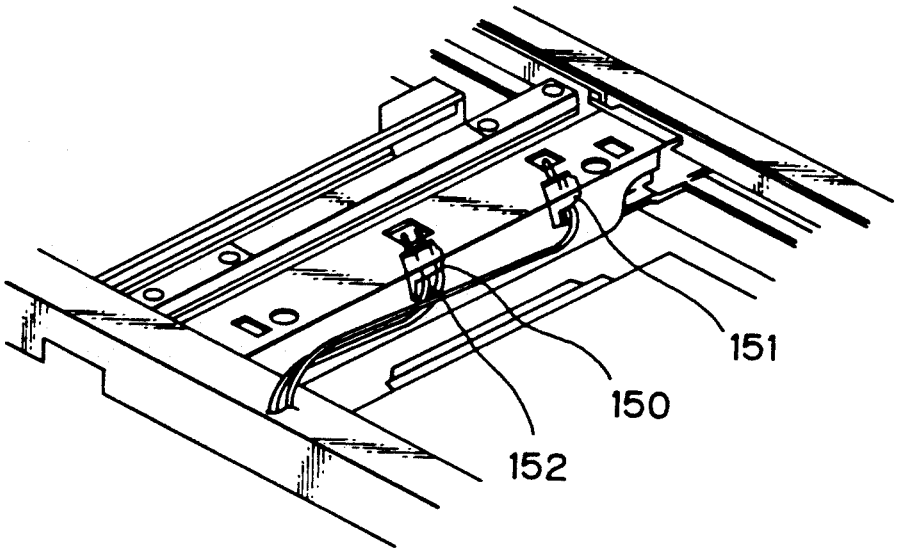
FIG. 24 is a perspective view of a document size sensor.
Figure 25:
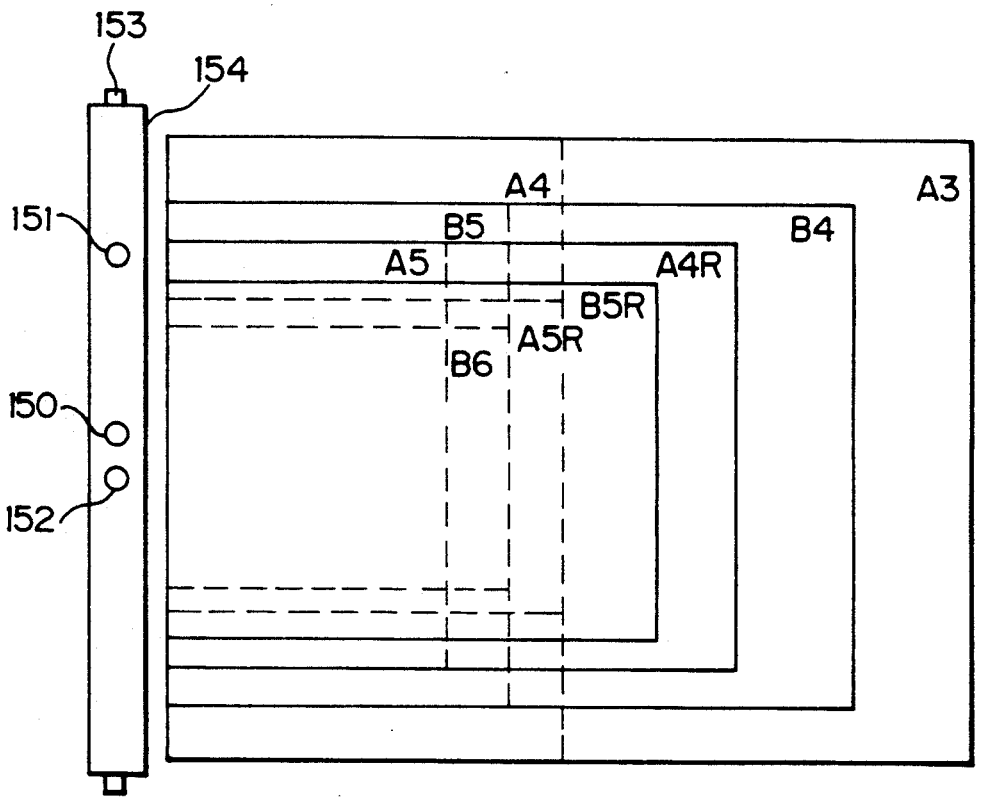
FIG. 25 is a view useful for understanding how a document size is detected.

A reference will be made to FIGS. 24 and 25 for describing how a document size is detected. In the figures, there is shown an automatic density adjusting system 150, a document width sensor 151, a document length sensor 152, a halogen lamp 153, and a first scanner 154. When a start key, not shown, is pressed, a document size is detected in response to the outputs of the sensors 151 and 152. Another approach for detecting a document size is the use of an optical encoder in which case a document length and, therefore, a document size will be determined on the basis of the number of output pulses of the encoder.

NINTH EMBODIMENT

This embodiment uses the integrated distance travelled by various paper sizes as the data relating to the life and the data corresponding to the number of image forming operations performed. Specifically, the size of documents or that of paper sheets is detected by the above-stated method, for example, and the number of passed paper sheets are detected also. The resulting data are transmitted to a CPU incorporated in a DTM to multiply the paper size and the number of passed paper sheets. A total travelled distance produced by such a procedure is used as a reference for life detection. The detection of life relying on the travelled distance is executed by the sequence of steps shown in FIG. 7, and a redundant description will be avoided for simplicity.

Figure 26:
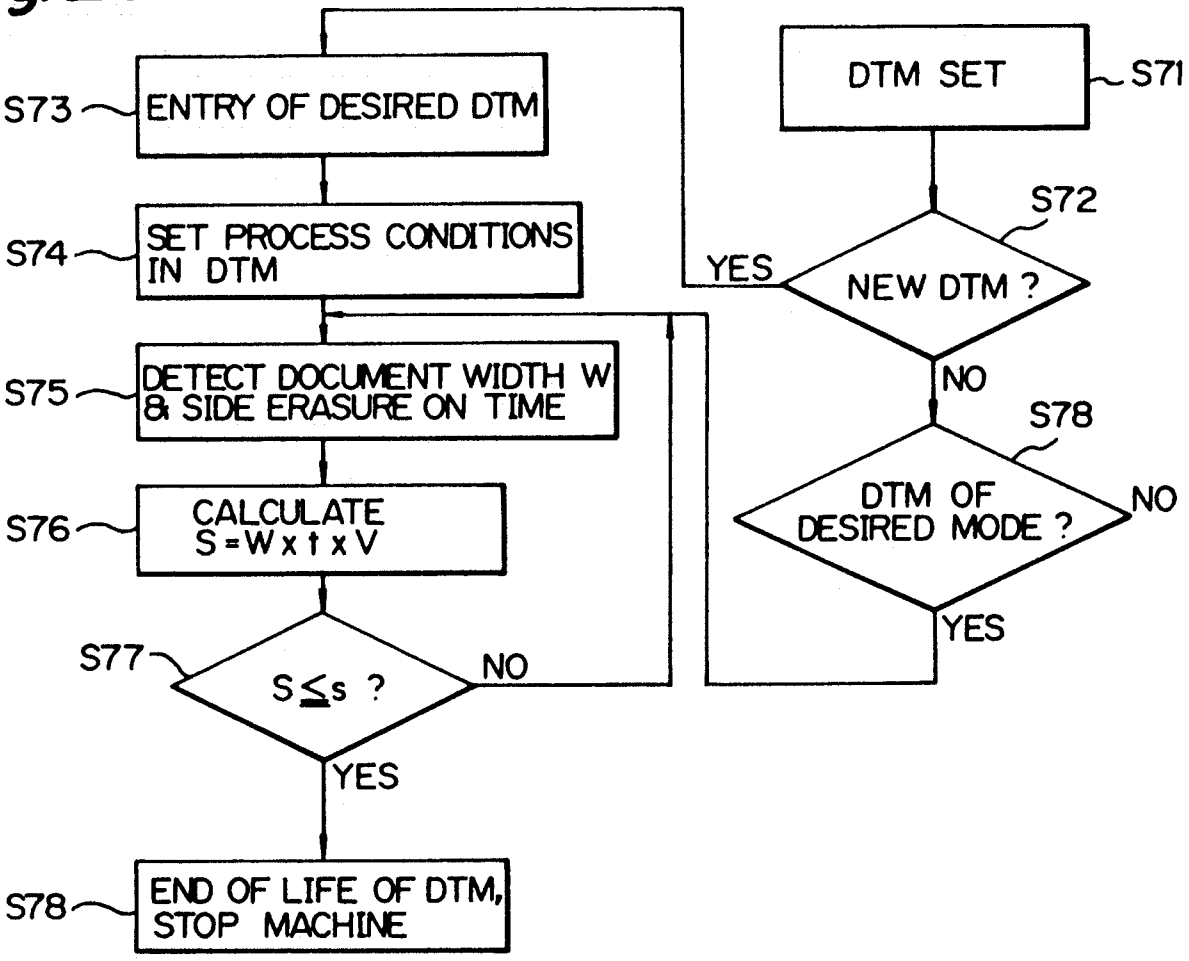
FIG. 26 is a flowchart demonstrating a specific operation based on the total image area.

FIG. 26 is a flowchart demonstrating a specific operation of the illustrative embodiment which uses the total area of images as a reference. The width w of a document size is detected by the sensor shown in FIGS. 24 and 25, for example, and the side erasure ON time t is detected (step S75). Then, the side erasure ON time (t), the drum speed (V) and the document width (w) are multiplied to produce an image area (s) (step S76).The image area s is compared with a predetermined total image area S which differs from one DTM to another, i.e., from one mode to another (step S77). If s is equal to or greater than S, the program stops the operation of the machine determining that the life of the DTM of interest has expired (step S78).

TENTH EMBODIMENT

This embodiment is practicable with the general construction shown in FIG. 1. In FIG. 1, the drum 4, light source 2, optics 3, developing unit 6, cleaning unit 9 and fixing unit 11 each is removable from the apparatus body 17 for replacement. Concerning the developing unit 6, exclusive units including a unit for photographs and a unit for color toner are prepared. The illustrative embodiment is implemented with toner concentration control of the type using a reference pattern, not shown, provided on the underside of the glass platen 1 outside of a document laying area, and a photosensor responsive to light reflected by the reference pattern. Specifically, when the quantity of light incident to the photosensor is greater than a predetermined value, a toner supply roller is driven for a predetermined period of time. Use may be made of either one of a one- or two-component dry developer or a liquid developer.

Figure 27:
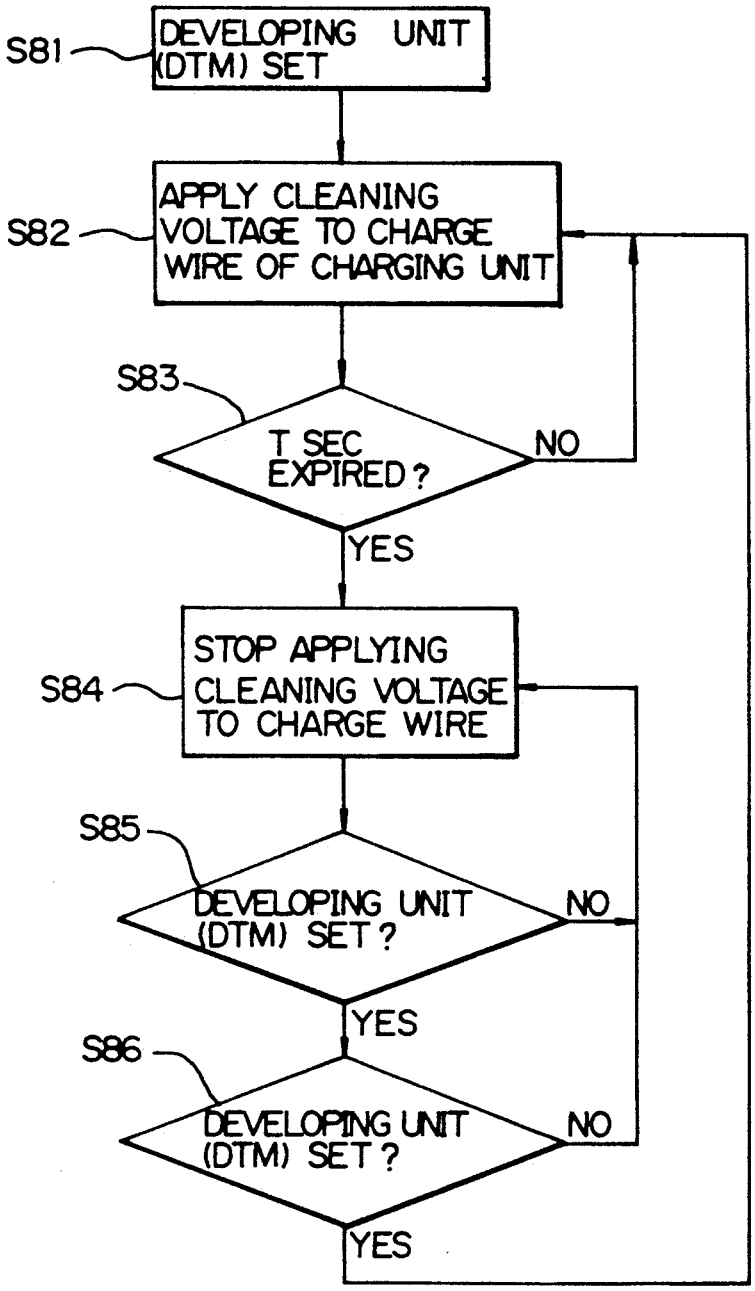
FIG. 27 is a flowchart showing a specific procedure for applying a cleaning voltage to the charge wire of a charging unit.

This particular embodiment is capable of cleaning a charge wire automatically when the developing unit 6 is replaced, as will be described with reference to FIG. 27. As shown, when the user mounts a desired developing unit 6 on the apparatus body, a sensor, not shown, disposed in a unit mounting section of the apparatus body senses the developing unit 6 (step S81). Then, a cleaning voltage is applied to the charge wire (step S82). The cleaning voltage generates an oscillating electric field whose polarity alternates, in the vicinity of the charge wire. Whether or not predetermined t seconds has expired is determined (step S83). If the answer of the step S83 is YES, the cleaning voltage is turned OFF (step (S84) and whether or not the developing unit 6 still exists on the apparatus body is determined (step S85). If the answer of the step S85 is YES, the cleaning voltage is maintained in the OFF state. If the answer of the step S85 is NO, whether or not a developing unit has been mounted is determined continuously (step S86). On the detection of a developing unit, the cleaning voltage is held in the OFF state. If the answer of the step S86 is NO, the cleaning voltage is applied to the charge wire for t seconds as in the step S82.

When the cleaning voltage is applied to the charge wire of the charging unit to generate the oscillating electric field, impurities deposited on the wire and opposite in polarity to the previously stated uniform charge are removed by the electric field component which is the same in polarity as the impurities. Since the charge wire can be cleaned without the charge wire and the photoconductive drum being removed from the apparatus body, they are free from damage likely to occur when the charging unit is removed from and inserted in the apparatus body. Furthermore, the cleaning voltage is applied and, therefore, the charge wire is restored to the initial state every time the developing unit 6 is mounted. This insures uniform charging with no regard to the type of the developing unit 6.

It should be noted that the charge wire of the charging unit is only an example of the members which need cleaning and may be replaced with the charge wire of the transferring unit or that of the separating unit or even with a cleaning member included in the cleaning unit 9.

ELEVENTH EMBODIMENT

Figure 28:
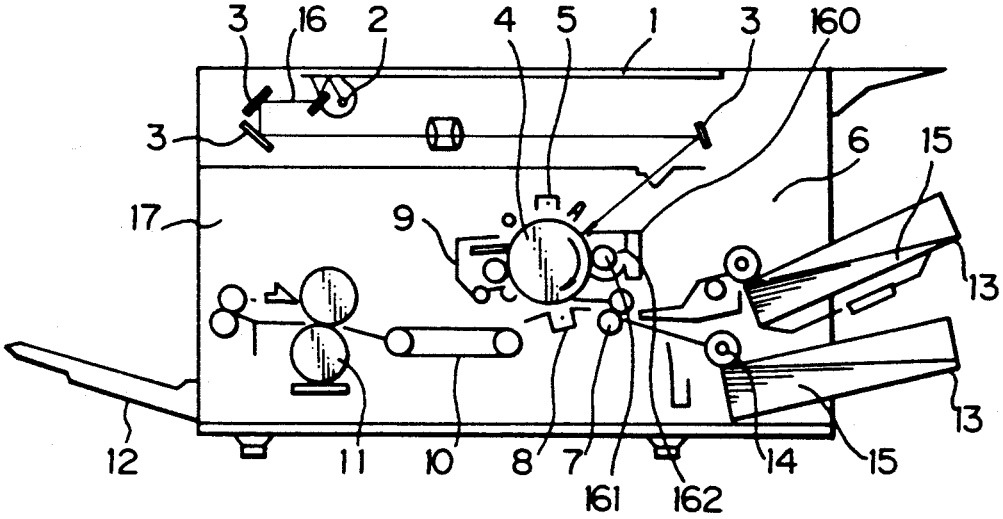
FIG. 28 is a section showing an image forming apparatus loaded with an image carrier cleaning unit.

Briefly, this embodiment allows a cleaning unit for cleaning a photoconductive element, or image carrier, to be inserted in a space of an apparatus body when a developing apparatus has been removed from that space. Specifically, as shown in FIG. 28, the image carrier cleaning unit, generally 160, has a casing which is configured to be insertable in the above-mentioned space, preferably in the same configuration as the casing of the developing unit. A sweeper roller 161 and a sweeper roller cleaning member 162 are disposed in the casing of the cleaning unit 160. The sweeper roller 161 may be made of the same material as a conventional sweeper roller which slightly shaves off the surface of the photoconductive drum 4 in order to remove toner filming and paper talc. Particularly, when the drum 4 is is made of OPC, the sweeper roller 161 may advantageously be made of polyester. The sweeper cleaning member 162 may be provided integrally with the casing or may be implemented as a separate member and affixed to the casing.

Assume that the user has removed the developing unit 6 from the apparatus body 17 determining that the drum 4 needs cleaning, by evaluating the image quality. When the user inserts the image carrier cleaning unit 160 in the space which the developing unit 6 has occupied, sensor means, not shown, provided in the apparatus body 17 senses the cleaning unit 160. Then, the sweeper roller 161 is rotated for predetermined t' seconds and then stopped, whereby toner filming and paper talc are shaved off from the surface of the drum 4. The drive of the sweeper roller 161 may be controlled in the same manner as the application of the cleaning voltage to the charge wire of the charging unit as effected in the tenth embodiment.

As stated above, the image carrier cleaning unit 160 is mounted on the apparatus body only when the user determines that the drum 4 needs cleaning by watching a reproduced image. The cleaning, therefore, does not reduce the service life of the drum 4. Since the drum 4 can be cleaned without being removed from the apparatus body, the drum and charging unit are free from damage likely to occur due to the removal and insertion of the charging unit.

TWELFTH EMBODIMENT

Figure 29:
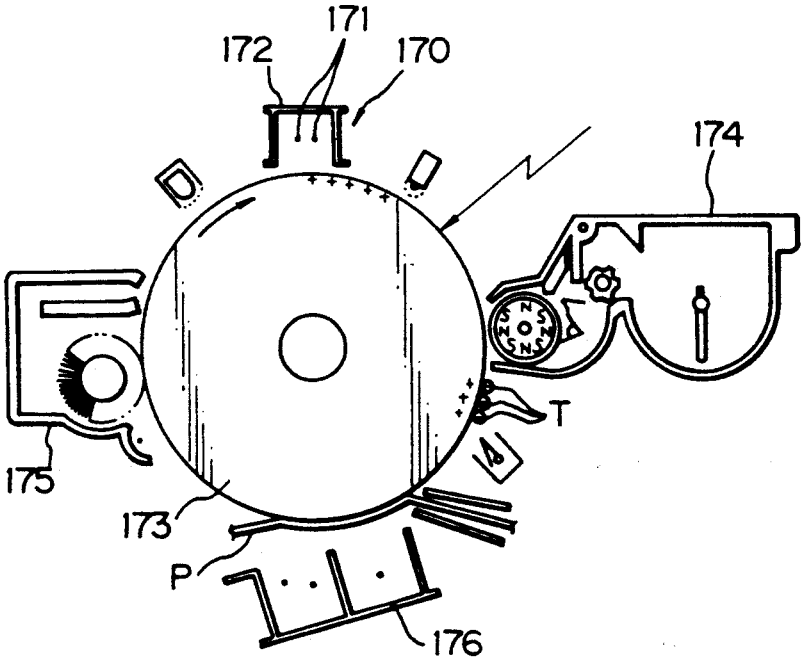
FIG. 29 is a section showing an image forming apparatus with which a twelfth embodiment of the present invention is practicable.

When the user intends to copy a document in a photograph mode or a color mode, the user mounts a particular developing unit matching the desired mode on the apparatus body. As shown in FIG. 29, a charging unit 170 is one of various image forming process units and mainly constituted by a charge wire 171 and a shield frame 172, as usual. Applied to the charge wire 171 is a DC voltage of a polarity necessary for forming an image, e.g. positive DC voltage if a photoconductive drum 173 is to be charged to a positive polarity. In response, the charging unit 170 uniformly charges the surface of the drum 173 to a positive polarity by corona discharge. After exposure, a developing unit 174 deposits a negatively charged toner T to portions of the drum 173 where the charge has been left (image portions), whereby a latent image is turned to a toner image. The problem with the charging unit 170 implemented as a corona discharger is that impurities such as paper talc and dust deposit on the charge wire 171. Should corona discharge be effected in such a condition, white stripes or the like would appear in the resulting image to degrade the image quality.

This embodiment contemplates to eliminate the above problem ascribable to impurities. The developing unit 174 is removable from the apparatus body, as stated earlier. Assume that the developing unit 174 once removed from the apparatus body is inserted again into the apparatus body, or that a developing unit which is a substitue for the developing unit 174 is inserted in the apparatus body. Then, the developing unit turns on a switch, not shown, which is provided in the apparatus body. As the power switch, not shown, of the apparatus body is turned on, a DC voltage whose polarity is opposite to the previously mentioned polarity (negative polarity in the illustrative embodiment) is applied to the charge wire 171 of the charging unit 170, causing corona discharge to occur. To charge the drum 1, this kind of charge wire 171 needs an extremely high voltage. In this condition, while impurities charged to the opposite polarity to the voltage are apt to deposit on the charge wire 171, it is possible to remove the impurities from the charge wire 171 by applying a voltage of the same polarity as the impurities to the charge wire 171. The term "predetermined period of time" mentioned earlier is long enogh to guarantee the removal of such impurities.

Figure 30:
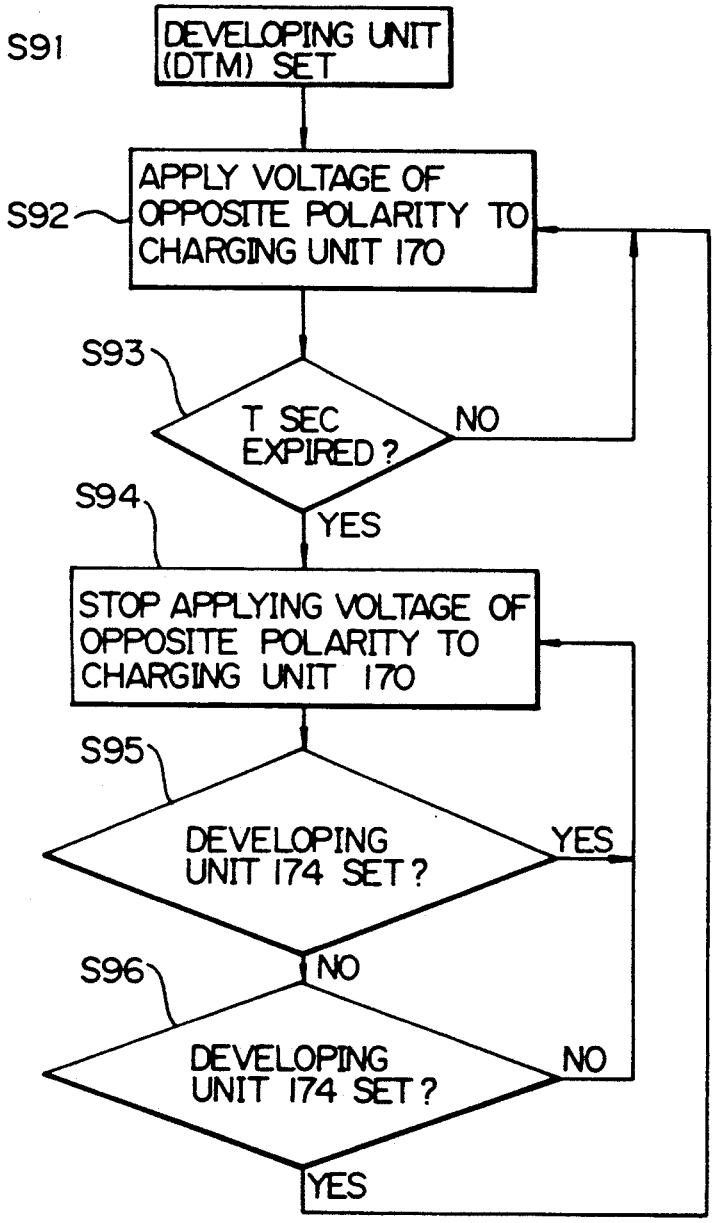
FIG. 30 is a flowchart associated with the twelfth embodiment.

FIG. 30 is a flowchart representative of a specific operation of the illustrative embodiment. In a step S93, the term "T SEC" is the period of time necessary for removing the impurities from the charge wire 171. On the lapse of t seconds, the voltage of the opposite polarity having been applied to the charging unit 170 is turned off (step S94). Thereupon, whether or not the developing unit 174 has been mounted on the apparatus body is determined (step S95). If the answer of the step S95 is YES, meaning that the developing unit 174 has been continuously set, the turn-off of the voltage of the opposite polarity is continued. If the answer of the step S95 is NO, meaning that the developing unit 174 was removed from the apparatus body leaving its exclusive space empty, whether or not the unit 174 has been mounted is determined again (step S96). If the answer of the step S96 is YES, the program returns to the step S92 for applying the voltage of the opposite polarity to the charging unit 170.

As stated above, the illustrative embodiment cleans the charge wire 171 automatically when a developing unit is inserted in the apparatus body.

In the illustrative embodiment, the removal of impurities has been triggered by a developing unit, but it may be caused by any other image forming process means, such as a cleaning unit 175. Specifically, it may be when the cleaning unit 175 is inserted in the apparatus body that the charging unit 170 causes corona discharge to occur. Thus, virtually all the removable units and even the photoconductive drum 173 are usable in triggering the removal of impurities. Among them, the developing unit 174 is especially desirable because it is expected to be frequently replaced for changing the developing mode. In the illustrative embodiment, a transfer charger 176 is implemented as a corona discharger to which a DC voltage is applied, and therefore the above-stated principle is also applicable to the transfer charger 176.

Another implementation available in the art for cleaning the surface of the drum 173 is a refresh magazine in the form of a vacuum unit which sucks toner particles or a unit which removes toner filming from a photoconductive drum. Specifically, a refresh magazine may be inserted in the exclusive space for the developing unit 174 or the cleaning unit 175 after the unit has been removed from the apparatus body. Such a refresh magazine also serves as an image forming process unit. An arrangement may be made such that when the magazine is mounted on the apparatus body, the DC voltage of the opposite polarity is applied to the corona discharger.

THIRTEENTH EMBODIMENT

This embodiment is practicable the general construction and control circuitry described earlier with reference to FIGS. 1 and 8. Again, a photoconductive drum, optics, developing unit, cleaning unit and fixing unit each is removable from the apparatus body.

Figure 31:
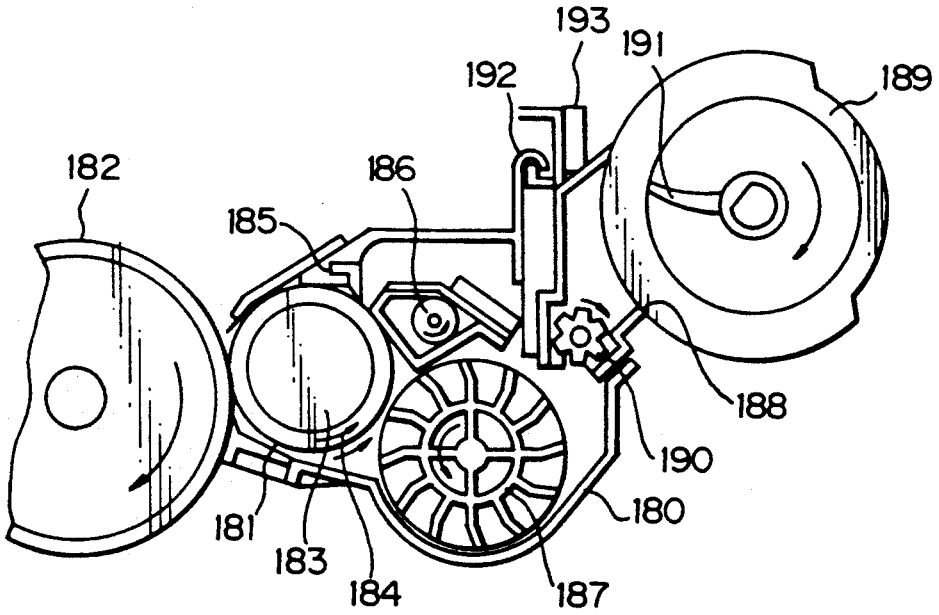
FIG. 31 is a section of a developing unit which is loaded with toner supply means and representative of a thirteenth embodiment of the present invention.

FIG. 31 shows a developing unit included in the illustrative embodiment. As shown, a casing 180 has a developing sleeve 181 thereinside. A part of the developing sleeve 181 faces a photoconductive drum 180 through an opening which is formed through the casing 180. The developing sleeve 181 is made of aluminum or similar non-magnetic material and provided with a hollow cylindrical configuration. The sleeve 181 is rotatable counterclockwise as indicated by an arrow in the figure and defines a developing region in a position where it faces the drum 182. A magnet roller 183 having opposite polarities alternating with each other is accommodated in the sleeve 181. By the magnetic force of the roller 183, a magnetic brush of magnetic carrier and toner is formed on the surface of the sleeve 181. As the sleeve 181 and roller 183 are rotated, the magnetic brush on the sleeve 181 is transported counerclockwise while particles constituting the brush are caused to magnetically spin. A magnetic shield plate 184 is disposed in the clearance between the sleeve 181 and the roller 183 and at the rear of the developing region in order to cause the developer remaining on the sleeve 181 after development to drop by gravity.

A doctor blade 185 is located above the developing sleeve 181 for regulating the thickness of the magnetic brush. The doctor blade 185 is spaced apart from the surface of the sleeve 181 by a predetermined gap. Located at the rear of the doctor blade 185 are a transport screw 186 and a scraper which cooperate to transport the excessive part of developer shaved off by the blade 185 to the bottom of the casing 180 while agitating it. An agitating roller 187 is located in a lower portion of the casing 180. A toner hopper 188 serving as a toner supply means and a toner cartridge 189 loaded with fresh toner are positioned at the rear end of the casing 180. The toner hopper 188 has an outlet in which a toner supply roller 190 is positioned for supplying the fresh toner to the casing 180. An agitator 191 is accommodated in the toner cartridge 189 for agitating the toner inside the cartridge 189. The toner hopper 188 and toner cartridge 189 are integrally removable from the apparatus body while being regulated by a guide 192 which is positioned at the rear end of the casing 180.

In operation, the agitator 191 in rotation drives the fresh toner out of the toner cartridge 189 toward the toner supply roller 190 situated in the hopper 188. The toner supply roller 190 in turn feeds the fresh toner into the casing 180 a predetermined amount at a time. This toner is mixed and agitated with the developer served developement and the excessive developer scraped off by the doctor blade 185 by the agitating roller 187. The resulting mixture is scooped up onto the sleeve 181 to form a magnetic brush thereon. While the magnetic brush is transported toward the developing region, the particles forming the brush spin due to the rotation of the magnet roller 183 and sleeve 181 and are thereby agitated and charged. In this instance, the doctor blade 185 regulates the thickness of the magnetic brush. On reaching the developing region, the magnetic brush contacts and develops an electrostatic latent image formed on the drum 2.

After the development, the developer on the developing sleeve 181 drops from the sleeve 181 in a position where it faces the magnetic shield plate 184. The agitating roller 187 in rotation mixes the so dropped developer with the fresh toner dropped from the toner supply roller 190, agitates them, and then scoopes them up again onto the sleeve 181. A storage in the form of a microcomputer 193 is mounted on the toner hopper 188 and loaded with image forming conditions beforehand. The image forming conditions include process conditions particular to the toner supply means and various detection data which are the conditions pertaining to the operation of the apparatus. Typical of the process conditions are the conditions for driving the toner supply roller 190, the conditions associated with the rotation speed of the roller 190, and data for making use of changes in copying speed (c.p.m). The detection data include data associated with the life of the toner supply means, remaining amount of toner, color of toner, function, toner end, and anti-compatibility of toner supply means.

Specific conditions for driving the toner supply roller 190 are as follows. A reference pattern having a predetermined density is provided on the underside of a glass platen outside of a document loading range. A photoelectric converter or photosensor is used to sense the amount of reflection from a developed image representative of the reference pattern. When a black toner is used, the supply roller 190 is driven for a predetermined period of time when the output of the photosensor is greater than a reference value assigned to the black toner (meaning that the amount of reflection is great). On the other hand, when a color toner is used, the toner supply roller 190 is driven for a predetermined period of time and every predetermined number of copies only if the output of the photosensor is smaller than a reference value assigned to the color toner (meaning that the amount of reflection is small).

The storage 193 associated with toner supply means which is loaded with a black toner stores the above-mentioned reference value for black toner as well as other data, while the storage associated with toner supply means which is loaded with a color toner stores the above-mentioned reference value for color toner (which differs color by color) as well as other data. This allows an image to be formed under particular toner feed roller drive conditions matching the kind of the toner supply means mounted on the apparatus body.

If desired, the storage may be loaded with image forming conditions of the apparatus body such as charging, exposing and fixing conditions in addition to the image forming conditions of the toner supply means.

Assume that the apparatus body is of the type allowing the user to select a solid image priority mode, line priority mode, photograph priority mode, tone priority mode or similar mode on a key, not shown, and switching the image forming conditions (which may include not only the image forming conditions of the toner supply means but also the charging, exposing, fixing and other image forming conditions) in matching relation to the selected mode. Then, each toner supply means may store image forming conditions on a mode-by-mode basis, so that it may form an image under particular conditions matching the mode selected on the key after it has been mounted on the apparatus body.

When the apparatus body does not have the mode selection capability mentioned above, there may be used exclusive toner supply means each being assigned to a particular mode (solid image priority mode, line image priority mode, photograph mode, tone priority mode, etc.) and loaded with associated image forming conditions. This also allows an image to be formed under particular conditions matching a desired mode, only if an adequate kind of toner supply means is mounted on the apparatus body.

Specifically, concerning the image forming conditions for the solid image priority mode, the toner supply means is loaded with a higher rotation speed of the magnet roller 183 than in the other modes in order to accentuate solid images. This is successful in forming an image to the user's taste, i.e. accentuating solid images in the above case.

In summary, in accordance with the present invention, a replaceable unit or part removable from the body of an image forming apparatus is provided with a storage. A mode selecting device is provided to allow the user to select a desired one of various image forming modes including a tone priority mode, photograph priority mode, and line image priority mode. A mode signal from the mode selecting device causes the storage of the replaceable unit or part to memorize particular image forming conditions matching the selected mode, so that the conditions for controlling a copy process and other factors are set up. The user, therefore, can select a desired image mode on the apparatus body to attain an image matching the user's taste. In addition, the image forming apparatus achieves improved functions.

In accordance with the present invention, use is made of a life storage for storing data associated with the life of a process unit which is removable from the body of an image forming apparatus. Hence, even when a certain process unit is replaced, the storage stores the part of the life thereof which has elasped and thereby promotes highly reliable life detection.

Further, in accordance with the present invention, an adequate image is achievable without damaging the surface of a photoconductive element which needs cleaning or the charge wire of a charging unit which also needs cleaning, without reducing the life of the photoconductive element, and even when a developing unit is replaced with another which is loaded with a different kind of developer.

Moreover, in accordance with the present invention, toner supply means in the form of a toner hopper which is removable from a developing unit is provided with a storage for storing image forming conditions. Hence, image forming conditions can be set up on a developer-by-developer basis without increasing the capacity required of a storage built in an apparatus body.

Various modifications will become possible for those skilled in the art after receiving the teachings of the present disclosure without departing from the scope thereof.

What is claimed is:

1. An image forming apparatus comprising:

a body;

an image carrier mounted on said body;

image forming means arranged around said image carrier for forming a desired visible image on said image carrier;

image transferring means for transferring the visible image to a paper sheet;

control means incorporated in said body for controlling operations of at least one of said image forming means and said image transferring means;

storage means provided on at least one of said image carrier, said image forming means and said image transferring means which is removable from said body for replacement;

mode selecting means for generating a mode selection signal representative of, among a plurality of image modes, a desired image mode; and image forming condition writing means for writing the selected desired image mode to said storage means in response to the mode selection signal, wherein control conditions of said control means are set up on the basis of said selected desired image mode.

2. An image forming apparatus as claimed in claim 1, wherein said image forming means is removable from said body and comprises copy mode storage means for storing data associated with a copy mode and fed from said body.

3. An image forming apparatus as claimed in claim 2, further comprising life storage means for storing data associated with a life which is predetermined in association with data relating to the copy mode, counter means for counting data associated with a number of times that an image forming operation is repeated, and comparing means for comparing the data associated with a life with the data associated with the number of times that an image forming operation is repeated.

4. An image forming apparatus as claimed in claim 1, wherein said storage means stores copy process conditions for said image modes.

5. An image forming apparatus as claimed in claim 4, wherein said body is provided with memory means, the copy process condition for said selected desired image mode being written by said storage means to said memory means of said body.

6. An image forming apparatus as claimed in claim 5, wherein said storage means controls operation of said apparatus in accordance with said copy process conditions written to said memory means of said body.

7. An image forming apparatus as claimed in claim 6, further comprising life storage means for storing data associated with a life which is predetermined in association with data relating to the copy mode, counter means for counting data associated with a number of times that an image forming operation is repeated, and comparing means for comparing the data associated with a life with the data associated with the number of times that an image forming operation is repeated.

8. An image forming apparatus as claimed in claim 7, wherein said data associated with said life comprises data relating to a duration of a black portion of an image signal associated with said life.

9. An image forming apparatus as claimed in claim 7, wherein said data associated with said life comprises data relating to a distance travelled by a scanner provided in said apparatus.

10. An image forming apparatus as claimed in claim 7, wherein said data associated with said life comprises data relating to the integrated distance travelled by sizes of documents or paper sheets.

11. An image forming apparatus as claimed in claim 7, wherein said image forming means comprises developer toner magazines (DTM), a life of each of said DTM being detected when said DTM is set.

* * * * *